US005371717A

United States Patent [19]

Bolorforosh

[11] Patent Number: 5,371,717

[45] Date of Patent: Dec. 6, 1994

[54] MICROGROOVES FOR APODIZATION AND FOCUSSING OF WIDEBAND CLINICAL ULTRASONIC TRANSDUCERS

[75] Inventor: Mir S. S. Bolorforosh, Palo Alto, Calif.

[73] Assignee: Hewlett-Packard Company, Palo Alto, Calif.

[21] Appl. No.: 77,188

[22] Filed: Jun. 15, 1993

[51] Int. Cl.[5] ..... H04R 17/00

[52] U.S. Cl. ..... 367/140; 367/150; 367/152; 367/157; 310/320; 128/662.03; 128/663.01

[58] Field of Search ..... 367/150, 152, 162, 176, 367/157, 905, 140; 310/320, 337, 322; 128/662.03, 663.01

[56] References Cited

U.S. PATENT DOCUMENTS

| | | | |
|---|---|---|---|
| 3,387,235 | 6/1968 | Fair | 333/30 |
| 4,097,835 | 6/1978 | Green | 367/150 |
| 4,460,841 | 7/1984 | Smith et al. | 367/155 |
| 4,462,092 | 7/1984 | Kawabuchi et al. . | |
| 4,542,653 | 9/1985 | Liu | 367/105 |
| 4,672,591 | 6/1987 | Breimesser et al. | 367/152 |
| 4,888,861 | 12/1989 | Day | 310/322 |
| 5,045,746 | 9/1991 | Wersing et al. | 310/334 |
| 5,115,809 | 5/1992 | Saitoh et al. | 128/662.03 |
| 5,142,187 | 8/1992 | Saito et al. | 310/358 |
| 5,175,709 | 12/1992 | Slayton et al. | 367/90 |
| 5,237,542 | 8/1993 | Burke et al. | 367/103 |

FOREIGN PATENT DOCUMENTS 90305961.6 5/1990 European Pat. Off. .

OTHER PUBLICATIONS

Wallace A. Smith, "Modeling 1-3 Composite Piezoelectrics: Thickness-Mode Oscillations," Jan. 1991, pp. 40-47.

R. E. Newnham et al., "Connectivity And Piezoelectric-Pyroelectric Composites," 1978, pp. 525-536.

M. I. Haller et al., "Micromachined acoustic matching layers," Jul. 21, 1992, pp. 72-77.

M. I. Haller et al., "Micromachined Ultrasonic Materials," 1991, pp. 403-405.

G. S. Kino, "Acoustic Waves," pp. 41-45.

*Primary Examiner*—J. Woodrow Eldred

[57] ABSTRACT

An ultrasonic probe including one or more piezoelectric ceramic elements mounted on an acoustically damping support body. Desired acoustic signals are transmitted and received through a front portion of the probe while unwanted acoustic signals are dampened by the support body at the rear portion of the probe. The present invention generates and efficiently focusses a main lobe of a beam of the acoustic signals. Furthermore, the invention provides for apodization of the acoustic beam to reduce extraneous acoustic signals corresponding to side lobes of the acoustic beam. Each element has a respective rear face and a respective first piezoelectric ceramic layer integral therewith to provide efficient acoustic coupling between the element and the acoustically damping support body. The respective first piezoelectric layer of each element includes shallow grooves disposed on the respective rear face of each piezoelectric element. A groove volume fraction of the piezoelectric layer is selected to control acoustic impedance of the first piezoelectric layer. Apodization of the beam is effected by varying the groove volume fraction of the respective first layer along an acoustic aperture of each element in accordance with a suitable apodization function. In accordance with a focussing function, a groove volume fraction of a respective second piezoelectric layer integral with each element is varied along the acoustic aperture, thereby effecting focussing of the acoustic beam. Electrodes extend into and contact the grooves, imposing electrical boundary requirements that support a desired electrical field distribution within the element.

20 Claims, 25 Drawing Sheets

MICROGROOVES FOR APODIZATION AND FOCUSSING OF WIDEBAND CLINICAL ULTRASONIC TRANSDUCERS

BACKGROUND OF THE INVENTION

The present invention generally relates to ultrasonic probes and more specifically to ultrasonic probes for acoustic imaging.

Ultrasonic probes provide a convenient and accurate way of gathering information about various structures of interest within a body being analyzed. In general, the various structures of interest have acoustic impedances that are different than an acoustic impedance of a medium of the body surrounding the structures. In operation, such ultrasonic probes generate a beam of broadband acoustic waves that is then coupled from the probe, though a lens, and into the medium of the body so that the acoustic beam is focussed by the lens and transmitted into the body. As the focussed acoustic beam propagates through the body, part of the signal is reflected by the various structures within the body and then received by the ultrasonic probe. By analyzing a relative temporal delay and intensity of the reflected acoustic waves received by the probe, a spaced relation of the various structures within the body and qualities related to the acoustic impedance of the structures can be extrapolated from the reflected signal.

For example, medical ultrasonic probes provide a convenient and accurate way for a physician to collect imaging data of various anatomical parts, such as heart tissue or fetal tissue structures within a body of a patient. In general, the heart or fetal tissues of interest have acoustic impedances that are different than an acoustic impedance of a fluid medium of the body surrounding the tissue structures. In operation, such a medical probe generates a beam of broadband acoustic waves that is then acoustically coupled from a front portion of the probe, through an acoustic lens, and into the medium of the patient's body, so that the beam is focussed and transmitted into the patient's body. Typically, this acoustic coupling is achieved by pressing the front portion of the probe having the lens mounted thereon into contact with a surface of the abdomen of the patient. Alternatively, more invasive means are used, such as inserting the front portion of the probe into the body through a catheter.

As the acoustic signal propagates through the patient's body, part of the acoustic beam is weakly reflected by the various tissue structures within the body and received by the front portion of the ultrasonic medical probe. By analyzing a relative temporal delay and intensity of the weakly reflected waves, an imaging system extrapolates an image from the weakly reflected waves. The extrapolated image illustrates spaced relation of the various tissue structures within the patient's body and qualities related to the acoustic impedance of the tissue structures. The physician views the extrapolated image on a display device coupled to the imaging system.

Because the acoustic beam produced by these ultrasonic probes is only weakly reflected by the tissue structures of Interest, it is important to try to concentrate the acoustic beam by efficiently focussing the acoustic beam. Such efficient focussing would insure that strength of the acoustic beam generated by the probe is enhanced as the signal is transmitted from the front portion of the probe, through the lens, and into the medium of the body. Additionally, such efficient acoustic focussing would insure that the weakly reflected acoustic waves are concentrated as they pass though the lens to be received by the front portion of the probe. Focussing is also desired to provide improved imaging resolution of structures within the body under examination.

Furthermore, since the acoustic waves are only weakly reflected by the tissue structures of interest, it is important to reduce any extraneous acoustic signals transmitted or received by the probe through the acoustic lens. In general, any physically realizable acoustic radiator has some finite aperture. As representatively illustrated in FIG. 1, diffraction of the acoustic waves 101 through the finite aperture, E, results in a desired main lobe 105 and undesired side lobes 107 arranged in a familiar intensity pattern corresponding to a function (sin x)/x. For example, if the acoustic beam generated by the probe is diffracted through the finite aperture of the acoustic lens, then a desired acoustic signal is transmitted into the patient along a main transmission lobe of the beam, and a first extraneous acoustic signal is transmitted into the patient along side transmission lobes of the beam. Similarly, because of the finite aperture of the acoustic lens, the probe receives another extraneous acoustic signal along side reception lobes in addition to reflected acoustic waves along the main reception lobe. Such extraneous acoustic signals can distort the extrapolated image viewed by the physician unless corrective measures are undertaken.

As previously known an ultrasonic probe comprises a layer of a dissimilar acoustic material adhesively bonded to a rear portion of a piezoelectric vibrator body. A thin layer of a cement adhesive is applied to bond each layer, thereby creating undesirable adhesive bond lines between the layers of dissimilar material and the piezoelectric body. The layer of material is in turn coupled to the acoustically damping support body. For example, FIG. 2 illustrates an ultrasonic transducer 200 comprising a piezoelectric vibrator body 204 of a piezoceramic, such as lead zirconate titanate having the acoustic impedance of $33*10^6$ kg/m$^2$s, a layer of dissimilar acoustic material such as silicon 206 having an acoustic impedance of $19.5*10^6$ kg/m$^2$s, a support body 208 of epoxy resin having an acoustic impedance of $3*10^6$ kilograms/meter$^2$second, kg/m$^2$s. The vibrator body 104 shown in FIG. 1 has a resonant frequency of 20 megahertz, MHz, and the silicon layer has a thickness that is a quarter wave length of the resonant frequency of the vibrator body. Electrodes 210 are electrically coupled to the vibrator body 204 for electrically sensing acoustic signals received by the transducer.

The piezoelectric vibrator body 204 shown in FIG. 2 is connected on one side to the silicon layer by means of an adhesive layer 212. The thickness of the adhesive layer is typically 2 microns. A silicon layer adhesively bonded to a piezoelectric body is also discussed in U.S. Pat. No. 4,672,591 entitled "Ultrasonic Transducer" and issued to Briesmesser et al. Because this patent provides helpful background information concerning dissimilar acoustic materials bonded to piezoelectric bodies, it is incorporated herein by reference.

Though the dissimilar acoustic matching materials employed in previously known schemes provides some advantages, the adhesive bonding of these layers creates numerous other problems. Bonding process steps needed to implement such schemes create manufacturing difficulties. For example, during manufacturing it is difficult to Insure that no voids or air pockets are introduced to the adhesive to Impair operation of the probe. Furthermore, reliability of this previously known transducers is adversely effected by differing thermal expansion coefficients of the layers of dissimilar materials and the piezoelectric ceramic bodies. Over time, for example over 5 years of use, some of the adhesive bonds may lose integrity, resulting in transducer elements that do not have efficient acoustic coupling to the damping support body. Additionally, operational performance is limited at higher acoustic signal frequencies, such as frequencies above 20 megahertz, by the bond lines between the piezoelectric body and the dissimilar materials.

One measure of such operational performance limitations is protracted ring down time in impulse response of the ultrasonic transducer of FIG. 2. Such impulse response can be simulated using a digital computer and the KLM model as discussed in "Acoustic Waves" by G. S. Kino on pages 41–45, which is incorporated herein by reference. FIG. 3 is a diagram of the simulated impulse response of the ultrasonic transducer of FIG. 3 having the resonant frequency of 20 Megahertz, radiating into water, and constructed in accordance with the principles taught by Briesmesser et al. In accordance with the impulse response diagram shown in FIG. 3, simulation predicts a −6 decibel ,db, ring down time of 0.221 microseconds, usec, a −20 db ring down time of 0.589 usec, and a −40 db ring down time of 1.013 usec.

Another previously known ultrasonic probe includes high-polymer piezoelectric elements. Each of the high-polymer piezoelectric elements comprises a composite block of piezoelectric and polymer materials. Such composites are discussed in U.S. Pat. No. 5,142,187 entitled "Piezoelectric Composite Transducer For Use in Ultrasonic Probe" and issued to Saito et al. Because this patent provides helpful background information concerning piezoelectric composites, it is incorporated herein by reference.

While composite materials provide other advantages, there are difficulties in electrically sensing reflected acoustic waves received by such composites. A dielectric constant of each high polymer element is relatively small. For example, for a composite that is 50% polymer and 50% piezoelectric ceramic, the dielectric constant measurable between electrodes of the high polymer element is approximately half of that which is inherent to the piezoelectric ceramic. Accordingly, the dielectric constant measurable between the electrodes of the high polymer element is only approximately 1700. A much higher dielectric constant is desirable so that a higher capacitive charging is sensed by the electrodes in response to the reflected acoustic waves. The higher dielectric constant would also provide an improved electrical impedance match between the probe and components of the imaging system electrically coupled to the probe.

What is needed is a reliable ultrasonic probe that provides enhanced operational performance, efficient electrical coupling to imaging system components, focussing of the main lobe of the acoustic beam, and reduced side lobes.

SUMMARY OF THE INVENTION

An ultrasonic probe of the present invention provides efficient and controlled acoustic coupling of one or more piezoelectric ceramic elements to an acoustically damping support body and further provides efficient electrical coupling of the elements to electrodes for electrically exciting and sensing acoustic signals. Desired acoustic signals are transmitted and received by a front portion of the probe while unwanted acoustic signals are dampened by the support body at the rear portion of the probe. The present invention is not limited by manufacturing, reliability, and performance difficulties associated with previously known acoustic coupling improvement schemes that employ adhesive cements to bond layers of dissimilar acoustic materials to piezoelectric ceramics. Additionally, the present invention generates and efficiently focusses a main lobe of a beam of the acoustic signals. Furthermore, the invention provides for apodization of the probe to reduce extraneous acoustic signals corresponding to side lobes of the acoustic beam.

Briefly and in general terms, the ultrasonic probe of the present invention employs one or more piezoelectric ceramic elements, each having a respective bulk acoustic impedance. A respective pair of the electrodes is coupled to each element. Preferably, the piezoelectric elements are arranged in a one or two dimensional phased array so that each element emits a respective individual acoustic beam that merges with the other individual beams of the array. Each element has a respective rear face and a respective piezoelectric ceramic layer integral therewith for substantially providing a desired acoustic impedance match between the bulk acoustic impedance of the element and the acoustically dampening support body. For electrical potential measurable between the respective pair electrodes, there is relatively little electrical potential difference along a respective thickness of the respective layer. Accordingly, the respective piezoelectric layer is substantially electromechanically inert. Each element further includes a respective bulk remainder portion that is electromechanically active and resonates at a desired bulk resonant frequency. By providing the acoustic impedance match, the inert piezoelectric layer helps to provide efficient acoustic coupling between the probe and the acoustically dampening support body.

The respective inert piezoelectric layer of each element includes shallow grooves disposed on the respective rear face of each piezoelectric element and extending through the thickness of the inert piezoelectric layer. More specifically, the shallow groves are microgrooves, typically extending into the respective face of each element less than 1000 microns. In general, a depth dimension of the grooves is selected to be approximately a quarter of a wavelength of the acoustic signals. A groove volume fraction of the inert piezoelectric layer Is selected to control acoustic impedance of the inert piezoelectric layer so as to provide the desired acoustic impedance match. Physical parameters such as groove width, W, and groove pitch, P are varied along an acoustic aperture of each element in accordance with an apedization function, thereby effecting apodization of a respective Individual beam of acoustic waves emitted by each element. Similarly, in accordance with a focussing function, a groove volume fraction of a respective second piezoelectric layer Integral with each element is varied along the acoustic aperture, thereby effecting focussing of the respective individual acoustic beam.

The respective pair of electrodes electrically coupled to the piezoelectric ceramic material of each element includes a respective front electrode coupled to a respective front face of each element, and a respective rear electrode coupled to the respective rear face of each element. The rear electrode extends into and contacts the grooves, imposing electrical boundary requirements that support a desired electrical field distribution within the element. Parameters such as width and pitch dimensions of the grooves are adjusted as needed so that for electrical potential measurable between the respective electrode pairs of each array element, there is relatively little electrical potential difference along the thickness of the respective inert piezoelectric layer of each element. For example, the width and pitch dimensions of the grooves are selected so that there is a relatively small electrical potential difference along the thickness of the inert piezoelectric layer that is less than approximately % 5 of the electrical potential measurable between the pair of electrodes. Because the electrical potential along the thickness of the inert piezoelectric layer is relatively small, the dielectric constant measurable between the electrodes of the element is relatively high and is substantially the same as that which is intrinsic to the ceramic material of the element.

As will be discussed in greater detail later herein, the relatively high dielectric constant is desired so that a high capacitive charging is sensed by the electrodes in response to reflected acoustic waves received by the piezoelectric elements of the probe of the present invention. The relatively high dielectric constant also provides for an improved electrical impedance match between the probe and components of an acoustic imaging system electrically coupled to the probe. Accordingly, the present invention is not burdened by difficulties associated with electrically sensing acoustic waves in previously known high polymer composites, which have a relatively low dielectric constant.

A manufacturing advantage associated with the present invention is that the grooves can be easily etched or cut into a wide ranges of piezoelectric materials. Furthermore, because the inert piezoelectric layer is integral with the piezoelectric element, the present invention provides impedance matching without being burdened by manufacturing and reliability problems that are associated with adhesively bonding layers of dissimilar layers to piezoelectric ceramics. High frequency performance of the ultrasonic probe constructed in accordance with the teachings of the present invention is not limited by adhesive bond lines present in some previously known ultrasonic probes.

Other aspects and advantages of the present invention will become apparent from the following detailed description, taken in conjunction with the accompanying drawings, illustrating by way of example the principles of the invention.

DETAILED DESCRIPTION OF PREFERRED EMBODIMENT

Figure 4:
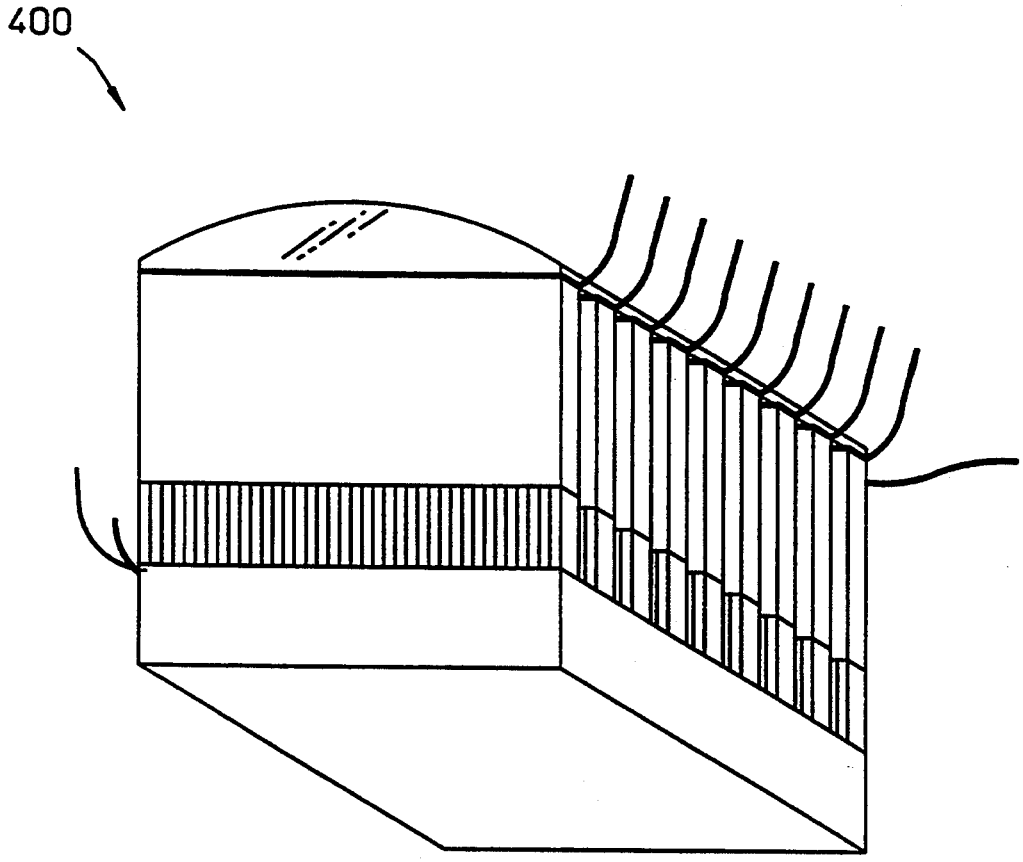
FIG. 4 shows an isometric view of an ultrasonic probe of a preferred embodiment of the present invention.
Figure 5:
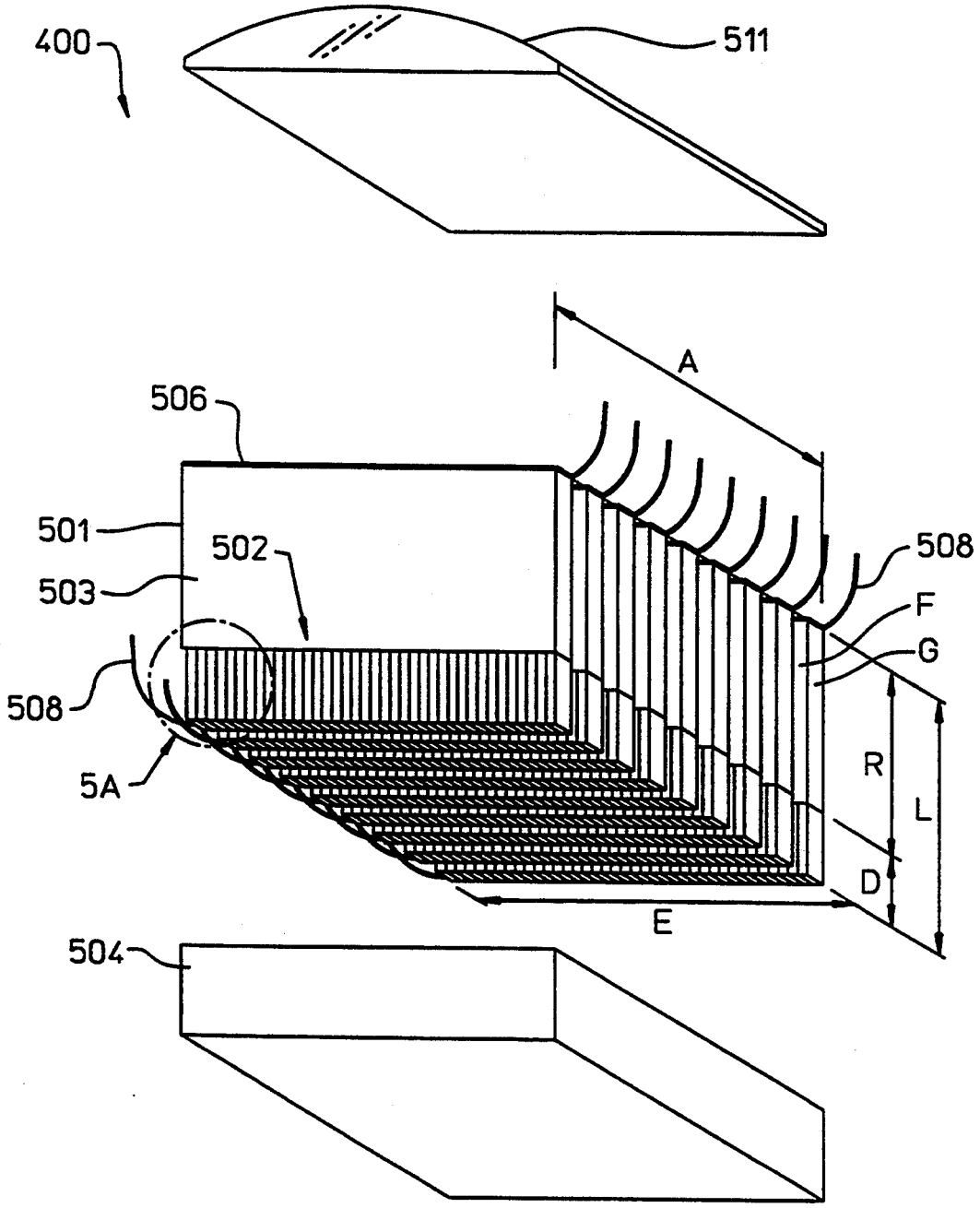
FIG. 5 shows a exploded view of the ultrasonic probe of FIG. 4.

The ultrasonic probe of the present invention provides efficient and controlled coupling of an acoustic signal between the probe and an acoustically damping support body, and further provides manufacturing, reliability and performance advantages. FIG. 4 is a simplified isometric view illustrating a preferred embodiment of the ultrasonic probe 400. FIG. 5 is an exploded view of the ultrasonic probe 400 shown in FIG. 4. As shown in FIG. 5, the preferred embodiment of the ultrasonic probe includes an array of piezoelectric ceramic elements 501, each having a bulk acoustic impedance $Z_{PZT}$ and each having a longitudinal dimension, L. Each element includes a respective piezoelectric ceramic layer 502 integral therewith and having a layer thickness defined by a depth dimension, D, of grooves extending through the layer. The respective piezoelectric layers are substantially electromechanically inert. Each piezoelectric element further includes a respective bulk remainder portion 503, which is electromechanically active and resonates at a desired bulk resonant frequency along a bulk remainder dimension, R, shown in FIG. 5A. It is preferred that the bulk remainder dimension, R, be selected to be a half of a wavelength of the desired bulk resonant frequency.

Each array element has an elevational dimension, E, corresponding to a respective elevational acoustic aperture of each element. Elevational aperture and the resonant acoustic frequency of each element are selected based on a desired imaging application. Typically, the elevational dimension, E, is selected to be between 7 and 15 wave lengths of the resonant acoustic frequency of the probe. As shown, the piezoelectric elements are arranged in a suitable spaced apart relation, F, along an azimuthal dimension, A, on the acoustically damping support body 504. The support body is essentially made of epoxy, or other suitable acoustically damping material. As shown, each element has a suitably selected lateral dimension, G. Furthermore, a number of elements in the array is selected based on requirements of the imaging application. For example, an ultrasonic abdominal probe for a medical imaging application typically includes more than 100 elements and an elevational aperture of 10 wave lengths. For the sake of simplicity, far fewer elements are shown in the probe of FIG. 5.

In the preferred embodiment, the piezoelectric elements are essentially embodied in specially contoured blocks of a piezoelectric ceramic material, such as lead zirconate titanate, PZT, each having a respective front face and rear face oriented approximately parallel to one another and being oriented approximately perpendicular to the respective longitudinal dimension, L, of each element. It should be understood that although PZT is preferred, other piezoelectric ceramic materials known to those skilled in the art may be alternatively employed In accordance with the principles of the present invention, with beneficial results.

The respective inert piezoelectric layer 502 integral with the respective rear face of each piezoelectric element substantially provides an acoustic impedance match between the bulk acoustic impedance of each piezoelectric element and the acoustic impedance of acoustically damping support body. As shown in detailed view 5A, the respective inert piezoelectric layer 502 integral with each piezoelectric element 501 of the array includes the grooves 505, which are disposed on the respective rear face of each element to control acoustic impedance of the layer. In the preferred embodiment, the grooves are arranged substantially parallel to one another along the respective elevational dimension, E, of each element. As will be discussed in greater detail herein, physical parameters such as groove width, W, and groove pitch, P are varied along the elevational dimension, E, of each element in accordance with an apodization function so as to effect apodization of a respective individual beam of acoustic waves emitted by each element.

Figure 5A:
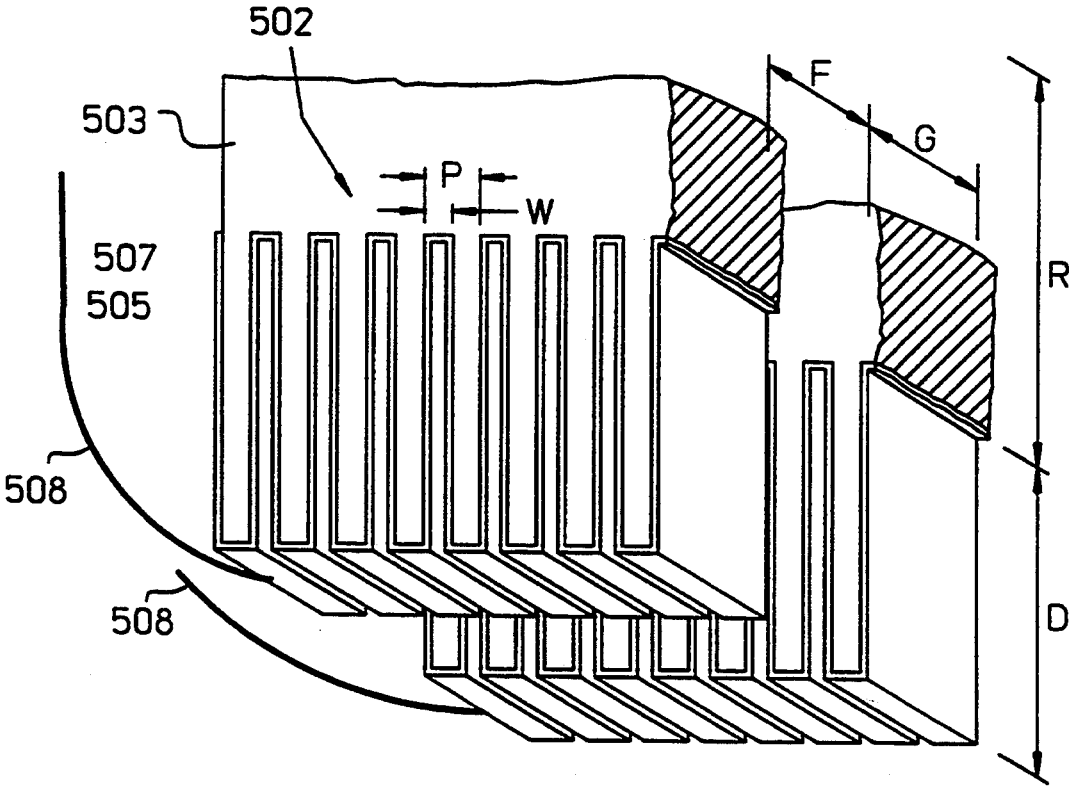
FIG. 5A shows a detailed cut away isometric view of FIG. 5.

As shown in FIGS. 5 and 5A, a respective pair of electrodes is electrically coupled to the piezoelectric ceramic material each piezoelectric element. The respective pair of electrodes of each element includes a respective front electrode 506 coupled to the respective front face of each piezoelectric element and further includes a respective rear electrode 507 extending into and contacting the grooves disposed on the respective rear face of each piezoelectric element. This arrangement of electrodes helps to insure that the piezoelectric layer is substantially electromechanically inert. A conformal material, preferably air, is disposed within the grooves adjacent to each electrode. As will be discussed in greater detail later herein, a suitable alternative conformal material, for example polyethylene, may be used instead of air. The selected conformal material has an acoustic impedance, $Z_{conformal}$, associated therewith.

By applying a respective voltage signal to the respective pair of electrodes coupled to each piezoelectric element, the bulk remainder portion of each element is excited to produce acoustic signals having the desired resonant frequency. Respective conductors 508 are coupled to each electrode for applying the voltage signals. The acoustic signals are supported in propagation along the respective longitudinal dimension of each element by a longitudinal resonance mode of the piezoelectric element. The respective acoustic signals produced by each piezoelectric element of the array are emitted together as the respective individual beams of acoustic waves. The individual beams of the elements of the array merge together into a single acoustic beam that is transmitted into the medium of the body under examination. For example, in a medical imaging application, the acoustic beam is transmitted into a patient's body. By controlling phasing of the respective voltage signals applied to each element of the array, phasing of the individual beams is controlled to effect azimuthal steering and longitudinal focussing of the merged acoustic beam, so that the merged acoustic beam sweeps though the body. An acoustic lens 511, shown in exploded view in FIG. 5, is acoustically coupled to the elements to provide elevational focussing of the acoustic beam. As will be discussed in greater detail later herein, in alternative embodiments grooves are employed on the front surface of each element to achieve elevational focussing and the acoustic lens 511 is eliminated.

As the acoustic signals propagate through the patient's body, portions of the signal are weakly reflected by the various tissue structures within the body, are received by the piezoelectric elements, and are electrically sensed by the respective pair of electrodes coupled to each piezoelectric element. The reflected acoustic signals are first received by the respective bulk portion of each piezoelectric element. The signals then propagate along the respective longitudinal dimension of each piezoelectric element. The signals then propagate through the respective inert piezoelectric layer integral with each piezoelectric element. Accordingly, the acoustic signals propagate through the bulk remainder portion of the piezoelectric element with a first velocity, and then propagate through the inert piezoelectric layer with a second velocity. It is preferred that the depth dimension, D, of the grooves of the inert piezoelectric layer be selected to be a quarter of a wavelength of the acoustic signals traveling through the inert piezoelectric layer.

The depth dimension, D, of the grooves defines thickness of the respective inert piezoelectric layer integral with each of the piezoelectric elements. The depth dimension, D, of each groove and the pitch dimension, P, of the respective grooves are selected to separate lateral and shear resonance modes of the inert piezoelectric layer from undesired interaction with the longitudinal resonance mode of the piezoelectric element. Furthermore, the depth and pitch of the grooves are selected to provide efficient transfer of acoustic energy through the inert piezoelectric layer. Additionally, the depth and pitch of the grooves are selected so that the inert piezoelectric layer appears homogenous to acoustic waves. In general, beneficial results are produced by a pitch to depth, P/D, of less than or equal to approximately 0.4, in accordance with additional groove teaching of the present invention discussed in greater detail later herein. The width and pitch dimensions of the grooves are further adjusted, if needed so that for an electrical potential measurable between the respective pair of electrodes of each array element, there is a relatively small electrical potential difference along the thickness of the inert piezoelectric layer. For example, the width and pitch dimensions of the grooves are selected so that there is an electrical potential difference along the thickness of the piezoelectric layer that is less than approximately % 5 of the electrical potential measurable between the respective pair of electrodes of each element.

To effect apodization of the respective individual acoustic beam, acoustic impedance of the respective inert piezoelectric layer is varied along the elevational dimension, E, of each element. Furthermore, acoustic impedance of the inert piezoelectric layer is controlled so as to substantially provide an acoustic impedance match between the bulk acoustic impedance of each piezoelectric element and an acoustic impedance of the acoustically damping support body. The acoustic impedance of the inert piezoelectric layer is substantially determined by groove volume fraction of the inert piezoelectric layer, which is based upon the width and pitch dimensions of the grooves 505 disposed on the respective rear face of each of the piezoelectric elements 501.

Apodization of the elevational aperture is achieved by varying the groove volume fraction of the piezoelectric layer along the respective elevational dimension of each element of the probe in accordance with a suitable apodization function, such as a hamming function. One way to achieved this is by appropriately incrementing or decrementing the respective groove volume fraction associated with each groove along the respective elevational dimension of each element. Alternatively, adjacent grooves are grouped into a number of zones along the respective elevational dimension of each element and a groove volume fraction associated with each zone is varied along the elevational dimension. As discussed previously herein, the groove volume fraction of the piezoelectric layer controls acoustic impedance of the piezoelectric layer. Acoustic impedance, in turn, determines a normalized sensitivity of the probe. Accordingly, apodization provides a desired normalized sensitivity profile along the elevational aperture.

Figure 6:
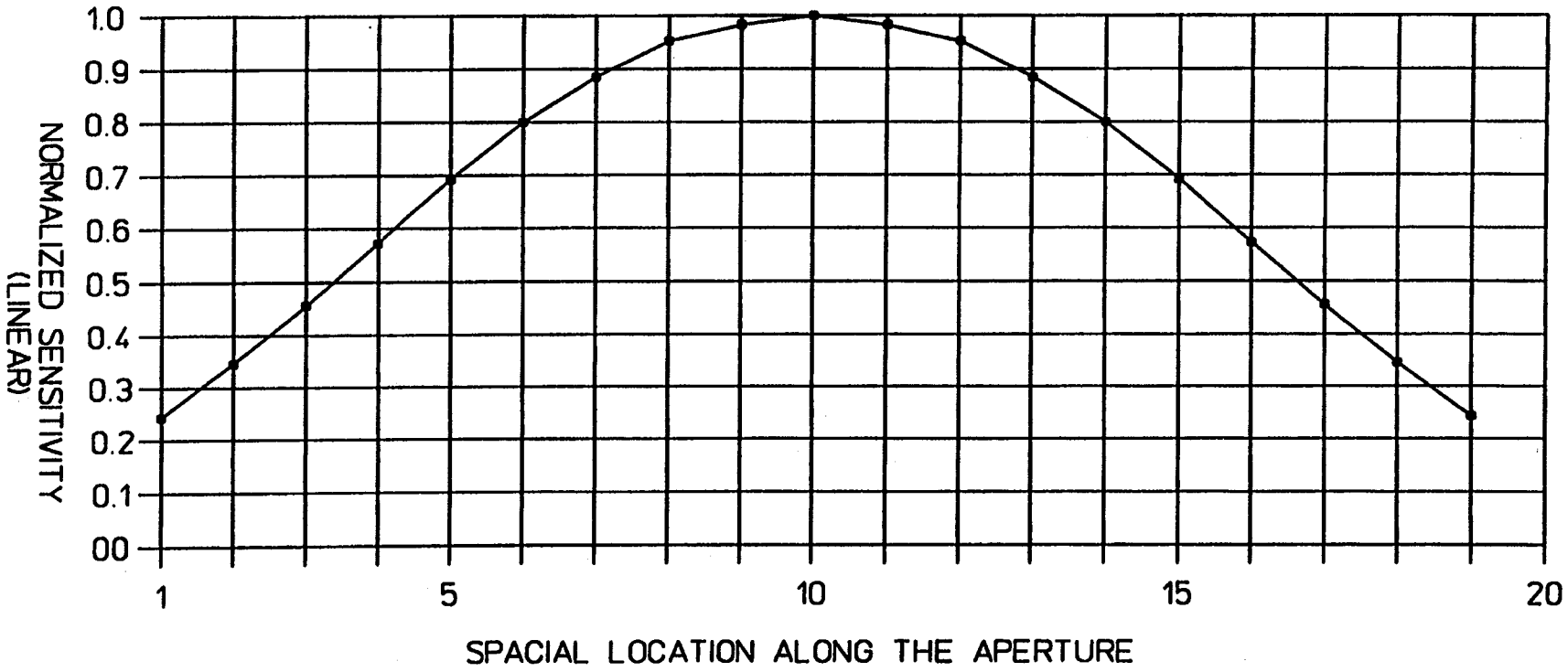
FIG. 6 is a diagram showing a desired normalized sensitivity versus spatial location along 19 illustrative zones of a respective elevational aperture of each element, in accordance with a suitable apodization function.
Figure 7:
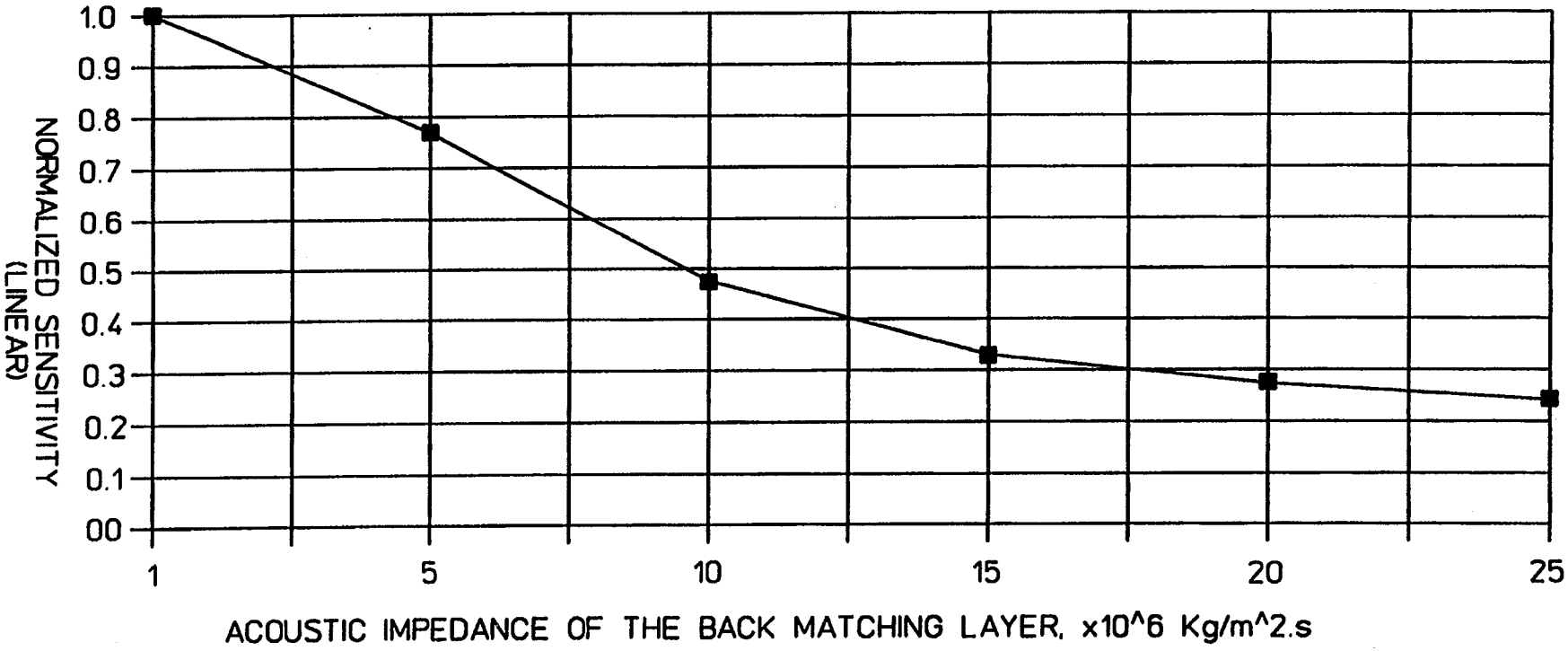
FIG. 7 Is a diagram showing normalized sensitivity of the probe versus acoustic impedance of a respective first piezoelectric ceramic layer integral with a rear face of each ceramic element of the probe.

For example, FIG. 6 is a diagram showing a desired normalized sensitivity versus spatial location along 19 illustrative zones of a respective elevational aperture of each element, in accordance with the apodization function. It should be understood that the number of zones actually used may be larger or small than 19 and that the 19 zones have been chosen for the sake of illustration. In general, a large number of zones is preferred. FIG. 7 is a diagram showing how normalized sensitivity of the probe relates to acoustic impedance of the respective inert piezoelectric ceramic layer integral with the rear face of each ceramic element of the probe. An acoustic impedance profile is then derived from FIGS. 6 and 7, in accordance with the apodization function. For example, FIG. 8 is a diagram showing acoustic impedance of the piezoelectric layer versus spatial location along the 19 zones of the elevational aperture.

Volume fraction of the grooves, as well as width and pitch of the grooves, are related to acoustic impedance as discussed previously. One way to vary the groove volume fraction along the elevational aperture is to vary the pitch of the grooves while maintaining a constant width dimension of the grooves. Another way to vary the groove volume is to vary the width of the dimension of the grooves. The groove volume fraction of the layer at any given point along the elevational dimension is defined by dividing a volume of a groove extending through the layer at the given point by a sum of the volume of the groove and a volume of remaining layer ceramic adjacent to the groove. Furthermore, a desired groove volume fraction, v, at the given point is calculated from the desired acoustic impedance of the layer at the given point and from respective acoustic impedances of the piezoelectric ceramic material and the conformal material. The desired volume fraction, v, at the point is approximately equal to an expression:

$$(Z_{PZT}-Z_{layer})/(Z_{PZT}-Z_{conformal})$$

Figure 8:
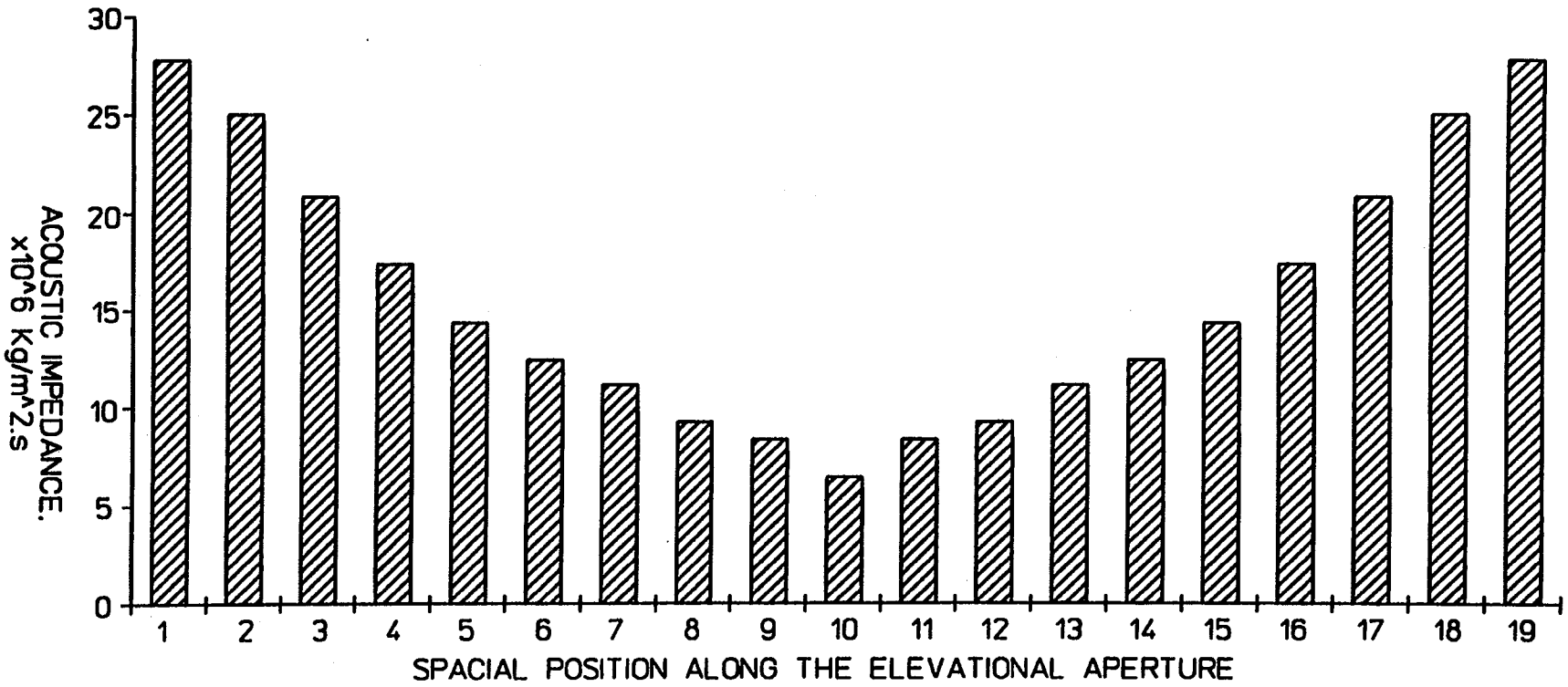
FIG. 8 is a diagram showing acoustic impedance of the first piezoelectric layer versus spatial location along the 19 zones of the elevational aperture, in accordance with the apedization function.

For example, the desired groove volume fraction for zone 5 illustrated in FIG. 8 is calculated as follows. Given that the desired acoustic impedance of the inert piezoelectric layer, $Z_{layer}$, at zone 5 shown in FIG. 8 is approximately $6.6*10^6$ kg/m$^2$s, given air as the conformal material having an acoustic impedance, $Z_{conformal}$, of 411 kg/m$^2$s, and given that the bulk acoustic impedance of the ceramic material of the element, $Z_{PZT}$, is $33*10^6$ kg/m$^2$s, the desired groove volume fraction of the inert piezoelectric layer, v, at zone 5 is approximately 80%.

It should be noted that a desired depth of the grooves, D, is calculated from a speed of sound in the inert piezoelectric layer, $C_{layer}$, and a quarter wavelength of the resonant acoustic frequency, f, of the piezoelectric element, using an equation:

$$D=\tfrac{1}{4}(C_{layer}/f)$$

Given that the desired groove volume fraction of the inert piezoelectric layer is approximately 80%, speed of sound in the inert piezoelectric layer, $C_{layer}$ can be estimated as being approximately $3.5*10^5$ centimeters/-second. Alternatively the speed of sound in the inert piezoelectric layer can be estimated using more sophisticated methods, such as those based on tensor analysis models of the inert piezoelectric layer. For instance, tensor analysis models discussed in "Modeling 1-3 Composite Piezoelectrics: Thickness-Mode Oscillations", by Smith et. al, pages 40-47 of IEEE Transactions on Ultrasonics, Ferroelectrics, and Frequency Control, Vol. 38. No 1, January 1991, can be adapted to estimate speed of sound in the inert piezoelectric layer. Given speed of sound in the inert piezoelectric layer, $C_{layer}$ estimated as $3.5*10^5$ centimeters/second and the desired bulk resonant frequency, f, as 2 MHz, the depth of the grooves, D, is approximately 437.5 microns.

A pitch, P, of the grooves is calculated so that the pitch is less than or equal to approximately 0.4 of the depth of the grooves:

$$P \leqq (0.4*D)$$

For example, given depth of the grooves, D, of approximately 437.5 microns, pitch of the grooves should be less than or equal to approximately 175 microns.

Width of grooves, W, is calculated based upon the pitch, P, the groove volume fraction, v, and a correction factor, k, using an equation:

$$W = P*v*k$$

A desired value for the correction factor, k, is selected based on connectivity of the ceramic of the inert piezoelectric layer and the conformal material. For the inert piezoelectric layer having grooves arranged as shown in FIGS. 5 and 5A, the layer has 2—2 connectivity with the conformal material and the correction factor, k, is simply 1. In alternative embodiments, the grooves are alternately arranged so that the layer has a different connectivity, yielding a different correction factor. For instance, in an alternative embodiment, the grooves are arranges so that the layer has a 1-3 connectivity, yielding a correction factor, k, of 1.25. Given 2—2 connectivity so that the correction factor, k, is 1, pitch of 175 microns, and groove volume fraction at zone 5 of the inert piezoelectric layer of 80%, the width, W, of the grooves at zone 5 is approximately 140 microns. In a similar matter as described above, width dimensions for grooves in each of the zones along the elevational aperture is determined.

A respective number of members in a set of grooves along the elevational dimension, E, of each piezoelectric element of the array is related to the pitch of the grooves and the respective elevational aperture of each element. Typically, the respective number of members in the set of grooves along the elevational dimension, E, is approximately between the range of 50 and 200 grooves to produce beneficial results. As an example, for a given preferred elevational dimension, E, of 10 wave lengths, a preferred respective number of grooves along the elevational dimension is approximately 100 grooves. For the sake of simplicity, fewer grooves than 100 grooves are shown in FIG. 5.

Front metal electrodes extend into and contact the grooves, imposing electrical boundary requirements that support a desired electrical field distribution within each element. Design parameters such as the width and pitch dimensions of the grooves are adjusted as needed so that for an electrical potential measurable between members of each electrode pair, there is a relatively small potential difference along the thickness of the respective piezoelectric layer of each element. For example, the width and pitch dimensions of the grooves are selected so that there is a relatively small potential difference along the thickness of the piezoelectric layer that is less than approximately % 5 of the electrical potential difference measurable between the respective pair of electrodes. It should be understood that for ultrasonic probes, there are several relevant sources of the electrical potential difference measurable between the respective pair of electrodes. For example, one relevant source of the electrical potential difference measurable between the respective pair of electrodes is voltage applied to the electrodes to excite acoustic signals in each piezoelectric ceramic element. Another relevant source of the electrical potential difference measurable between the respective pair of electrodes is voltage induced in each piezoelectric element by weakly reflected acoustic signals received by each element.

Figure 9:
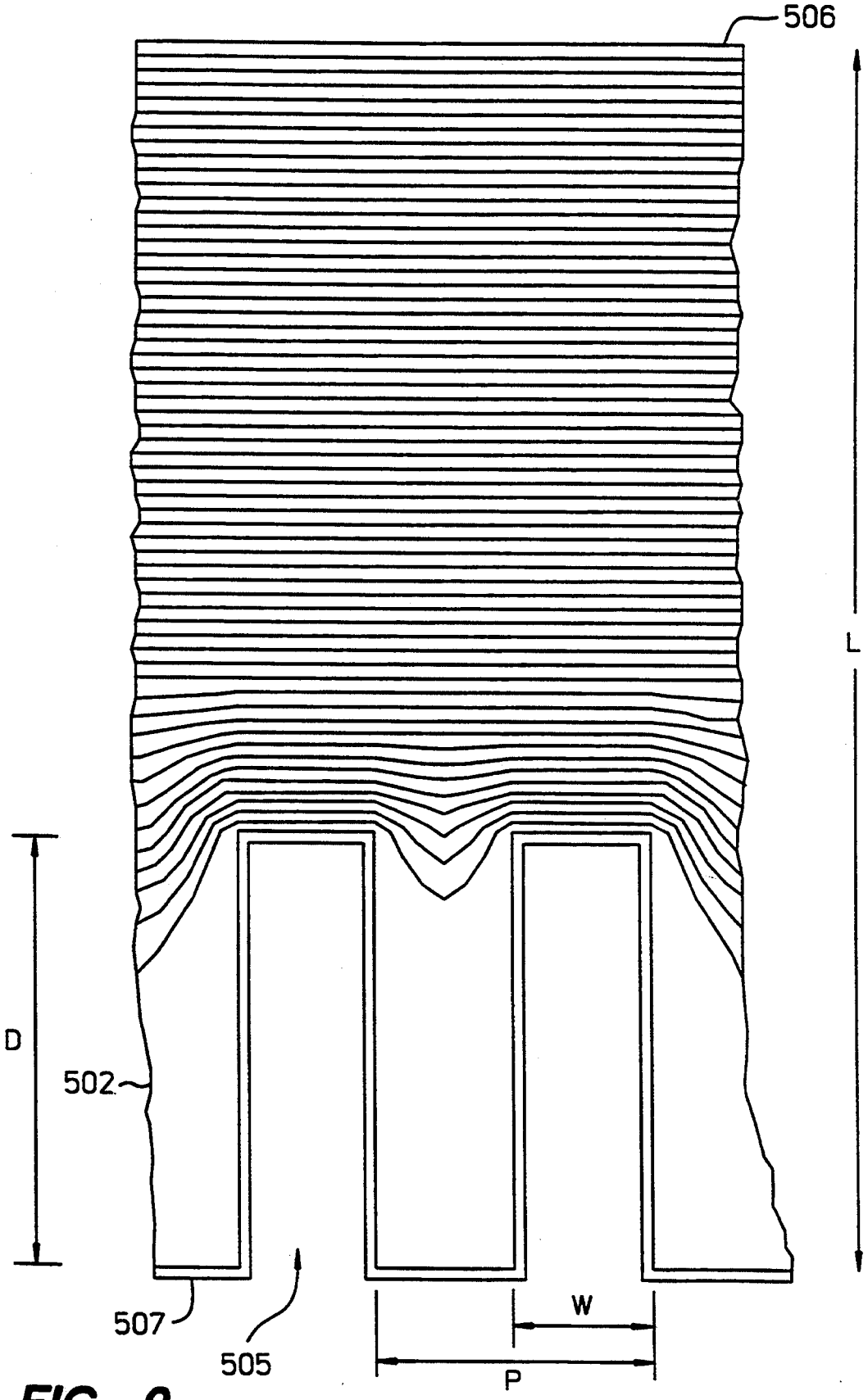
FIG. 9 is a diagram illustrating lines of electric equipotential distributed along a longitudinal dimension of a piezoelectric element of the probe of FIG. 5.

The relatively small electrical potential difference along the thickness of the piezoelectric layer is graphically illustrated in FIG. 9. FIG. 9 is a detailed cut away sectional view of one of the piezoelectric elements of FIG. 5, providing an illustrative diagram showing lines of electrical equipotential distributed along the longitudinal dimension, L, of the element for the example of width and depth of grooves discussed previously herein. Although lines of electrical equipotential are invisible, representative lines are drawn into the diagram of FIG. 9 for illustrative purposes. As shown in cross section, grooves having pitch, P, width, W, and depth, D, extend into the rear face of the element, through the thickness of the piezoelectric layer 502. Given an exemplary 1 volt potential measurable between the pair of electrodes 506, 507, the lines of equipotential shown in FIG. 9 correspond to 0.01 Volt increments in potential. Since electrical boundary requirements provide that there is substantially no tangential component of any electrical field at a conductor boundary, and since electric field distributions change gradually, the rear metal electrodes extend into and contact the grooves to impose electrical boundary requirements that support the desired electrical field distribution within the element. As shown in FIG. 9, there is a relatively small electrical potential difference along the thickness of the inert piezoelectric layer that is only approximately % 3 of the electrical potential applied to the pair of electrodes of the array element. Because the electrical potential difference along the thickness of the inert piezoelectric layer is relatively small as shown in FIG. 9, the dielectric constant measurable between the electrodes 506, 507 of the element is substantially the same as that which is intrinsic to the lead zirconate titanate material of the element, and therefore is relatively high. Furthermore, the relatively small potential difference along the thickness of the piezoelectric layer further helps to insure that the piezoelectric layer is substantially electromechanically inert.

Upon the element receiving weakly reflected acoustic signals as discussed previously herein, capacitive charging of the electrodes is driven by a displacement current. The displacement current is linearly proportional to a product of an electric potential measurable between the respective pair of electrodes and the dielectric constant. Accordingly, the relatively high dielectric constant provides a relatively high capacitive charging. The high capacitive charging is desired to efficiently drive cabling that electrically couples the electrodes to imaging system components, which analyze a relative temporal delay and intensity of the weakly reflected acoustic signal received by the probe and electrically sensed by the electrodes. From the analysis, the imaging system then extrapolates a spaced relation of the various structures within the body and qualities related to the acoustic impedance of the structures to produce an Image of structures within the body.

Similarly, electrical impedance measurable between electrodes of each element is inversely proportional to the dielectric constant of each element. The relatively high dielectric constant provides a relatively low electrical impedance. The low electrical impedance of each element is desired to provide an improved electrical impedance match to a low electrical impedance of the cabling and to a low electrical impedance of imaging system components.

Figure 10A:
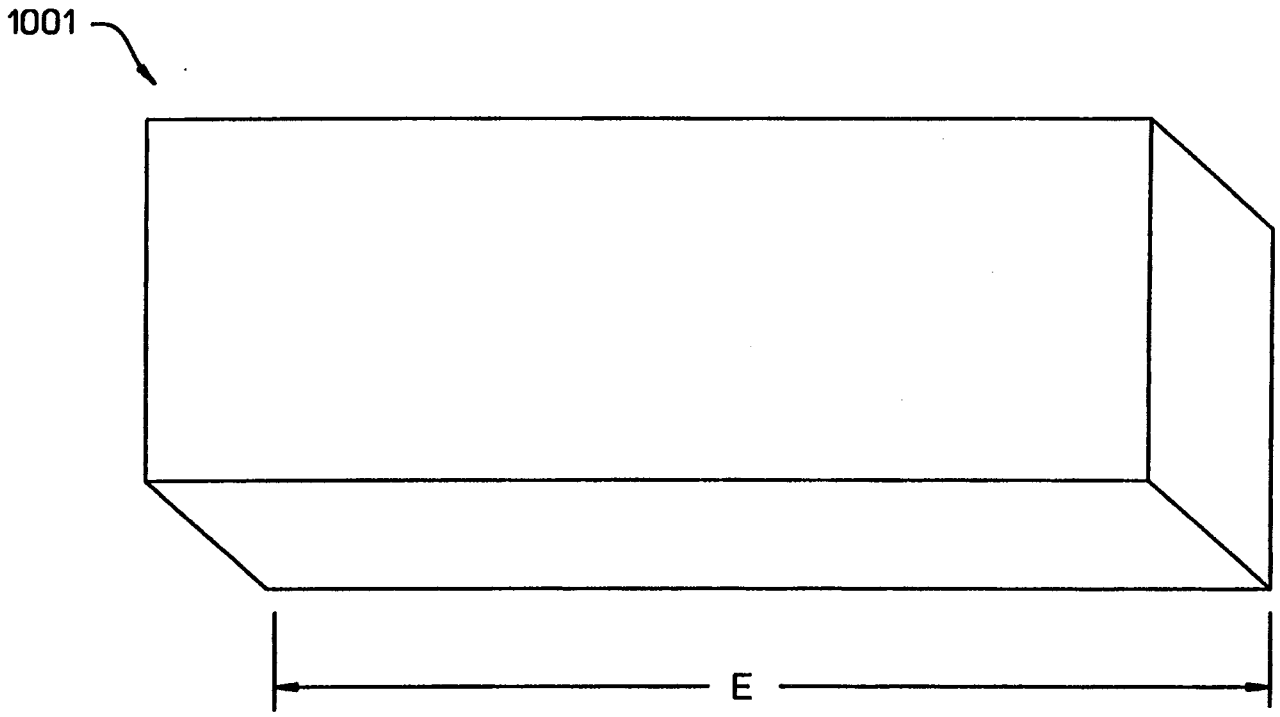
FIGS. 10A–D are simplified isometric views illustrating steps in making the probe of FIG. 5.
Figure 10B:
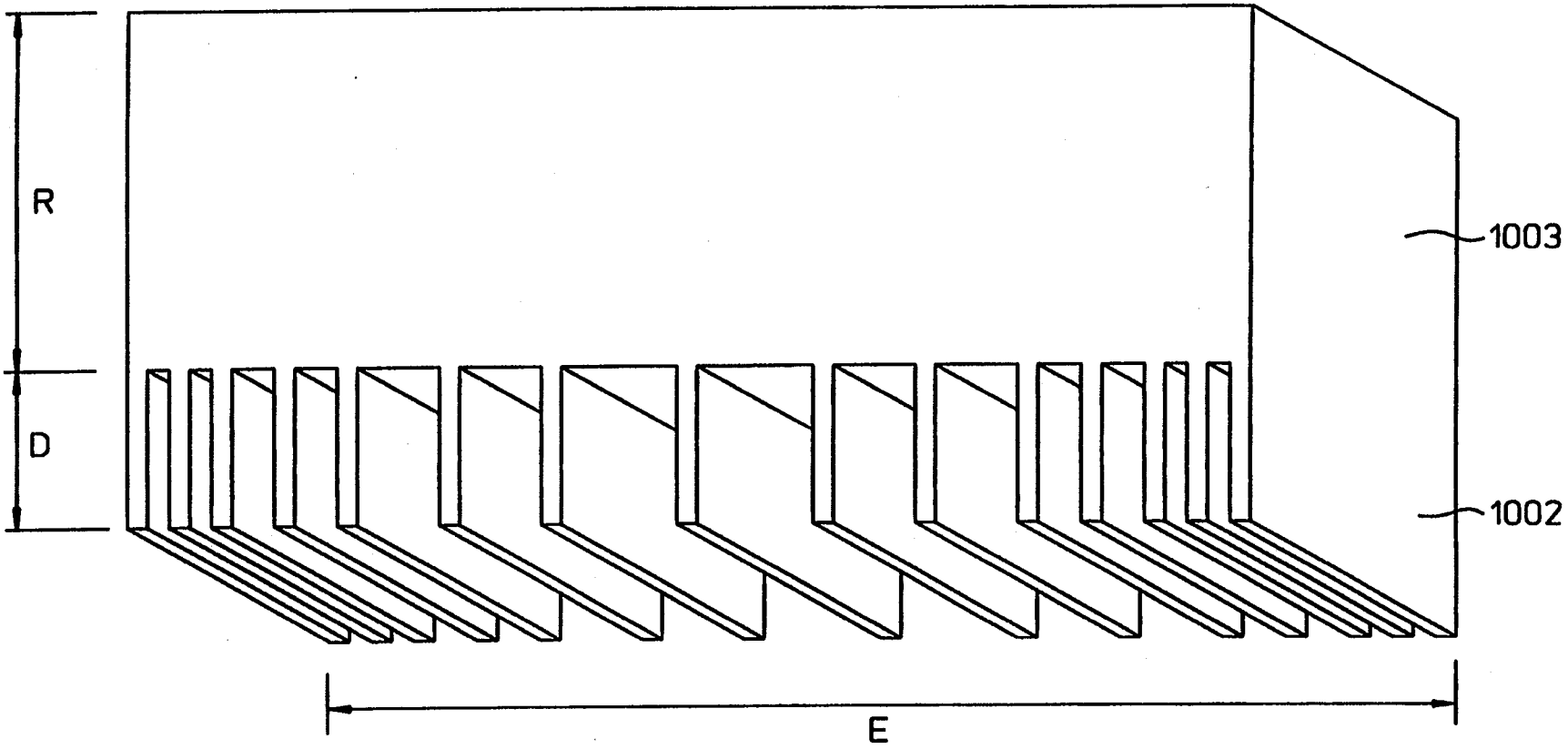
Figure 10C:
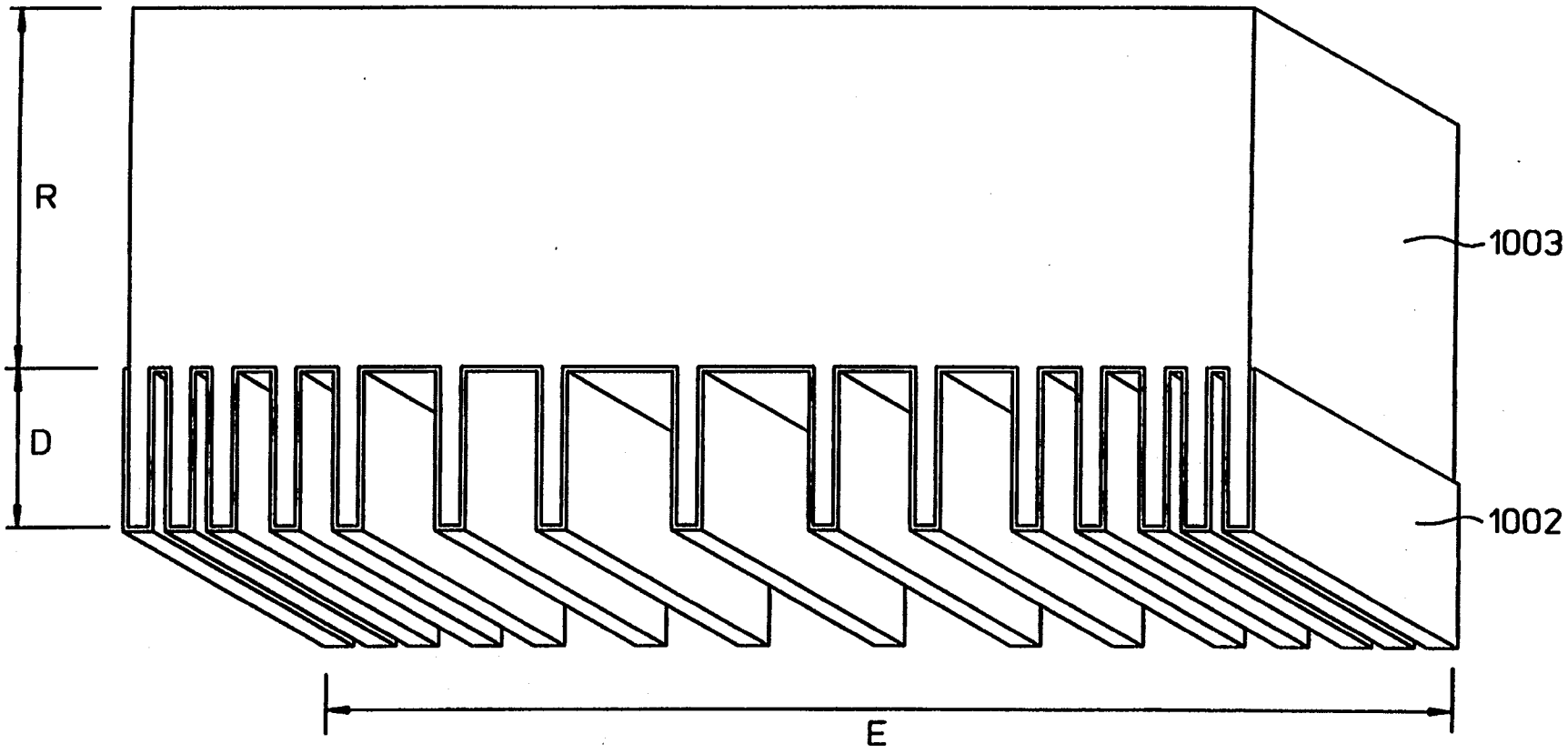
Figure 10D:
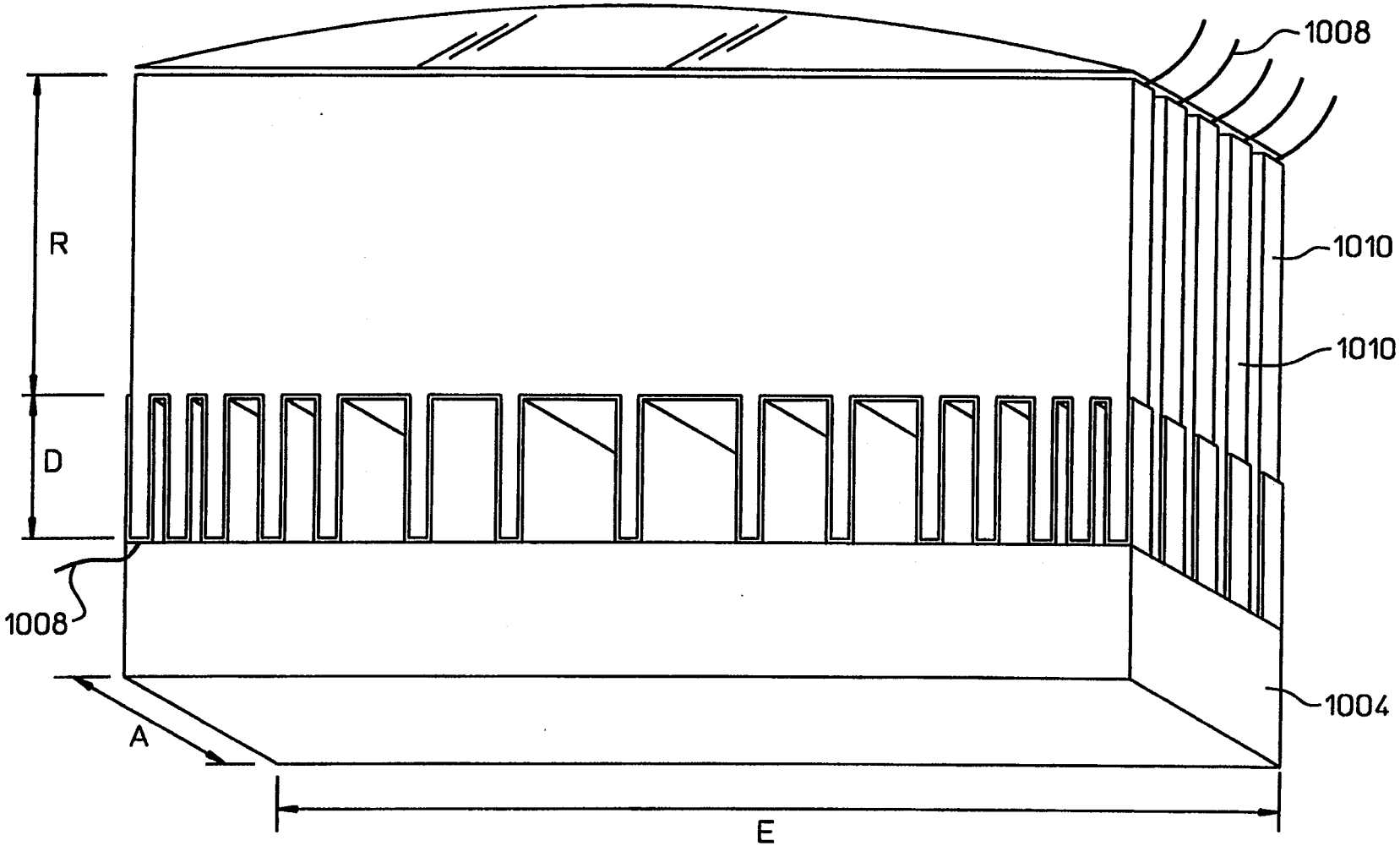

Fabrication, poling, and dicing of the piezoelectric elements of the array are illustrated and discussed with reference to simplified FIGS. 10A–D. An initial step is providing a slab 1001 of raw piezoelectric ceramic material having an elevational dimension, E, as shown in FIG. 10A. Since the raw material has not yet been poled, there is only random alignment of individual ferroelectric domains within the material and therefore the material is electromechanically inert. As shown in FIG. 10B, the slab includes an Inert piezoelectric layer 1002 integral with the slab and a bulk remainder portion 1003 of the slab. The bulk remainder portion has a remainder dimension R. The inert piezoelectric layer is characterized by grooves 1005 having a depth, D, cut into a rear face of the slab and extending through a thickness of the layer. The grooves are cut into the slab using a selected blade of a dicing machine. Groove volume fraction of the piezoelectric layer is varied along the elevational dimension, E, of the slab in accordance with the apodization function by varying the width of the grooves. Width of the blade is selected so that the grooves have the appropriate width dimension, W, in each zone along the elevational dimension, E. Controls of the dicing machine are set to cut the grooves at the desired pitch, P, and depth, D. Alternatively, photolithographic processes utilizing chemical etching may be employed to etch the grooves into the rear surface of tile slab at the desired pitch, depth, and width. As another alternative, the grooves can be ablated onto the rear face of the slab using a suitable laser.

Metal electrodes are deposited onto the slab by sputtering. As shown in FIG. 10 C, a thin metal film having a selected thickness between approximately 1000 to 3000 angstroms is sputtered onto the rear face of the slab to produce a rear electrode 1007. Another similar thin metal film is sputtered onto the front face of the slab to produce a front electrode 1006. The metal film of the rear electrode 1007 extends into and contacts the grooves in the rear face of the slab.

A poling process comprises placing the slab into a suitable oven, elevating a temperature of the slab close to a curie point of the raw piezoelectric ceramic material, and then applying a very strong direct current, DC, electric field of approximately 20 kilovolts/centimeter across the front and rear electrodes while slowly decreasing the temperature of the slab. Because an electrical potential difference along the thickness of the inert piezoelectric layer including the grooves is only a small fraction of a total electrical potential between the electrodes, the inert piezoelectric layer 1002 substantially retains the random alignment of individual ferroelectric domains present in the raw piezoelectric material. Accordingly, the inert piezoelectric layer 1002 is only very weakly poled and remains electromechanically inert. The weak poling of the piezoelectric layer further helps to insure that the layer is electromechanically inert. In contrast, the poling process aligns a great majority of individual ferroelectric domains in the bulk remainder portion 1003 of the piezoelectric slab. Accordingly, the bulk remainder portion 1003 of the slab is very strongly poled and is electromechanically active.

Conformal material is disposed in the grooves. As discussed previously herein, in the preferred embodiment the conformal material is a gas, such as air. In another preferred embodiment, the conformal material is a low density conformal solid, such as polyethylene. Conducting leads 1008 shown in FIG. D are electrically coupled to the metal films using a wire bonding technique. Alternatively, the conducting leads may be electrically coupled to the metal films by a very thin layer of epoxy or by soldering. An acoustically damping support body 1004 made from an epoxy based backing material is cast on the rear face of the slab to support the slab. The dicing machine cuts entirely through the piezoelectric slab at regularly spaced locations to separate distinct piezoelectric elements of the array 1010. An acoustic lens is cast from a suitable resin on the front face of the piezoelectric elements.

The inert piezoelectric layer provides enhanced operational performance at high acoustic frequencies in part because the layer is integral with the piezoelectric element. In previously known ultrasonic transducers, a dissimilar layer acoustic material was made separate from the piezoelectric element and then bonded to the transducers using a typical 2 micron layer of adhesive cement, resulting in performance limitations as discussed previously herein. One measure of the enhanced operational performance is reduced ring down time in impulse response of the piezoelectric elements of the probe of the present invention. Such impulse response can be simulated using a digital computer and the KLM model as discussed previously herein.

Figure 1:
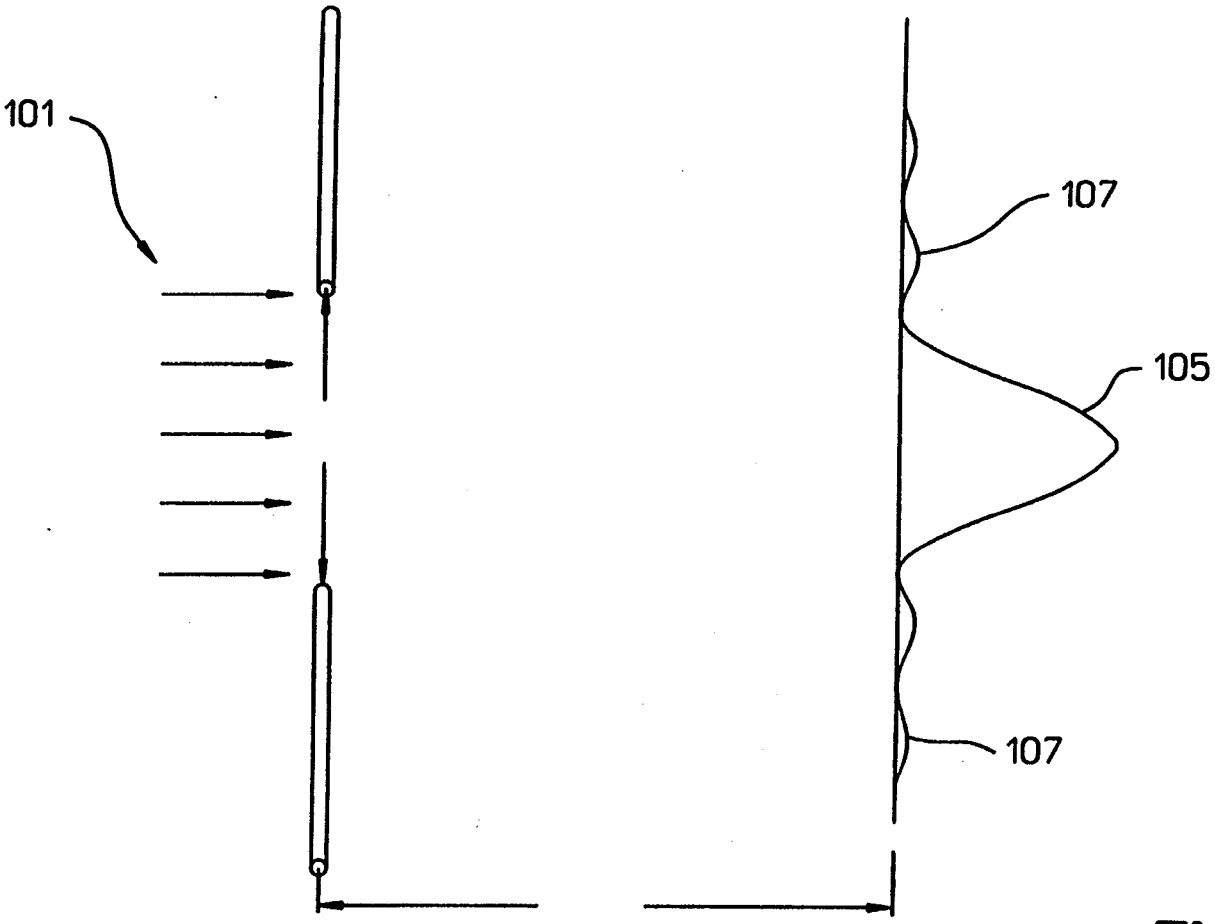
FIG. 1 is a diagram illustrating diffraction of acoustic waves through a finite acoustic aperture.
Figure 2:
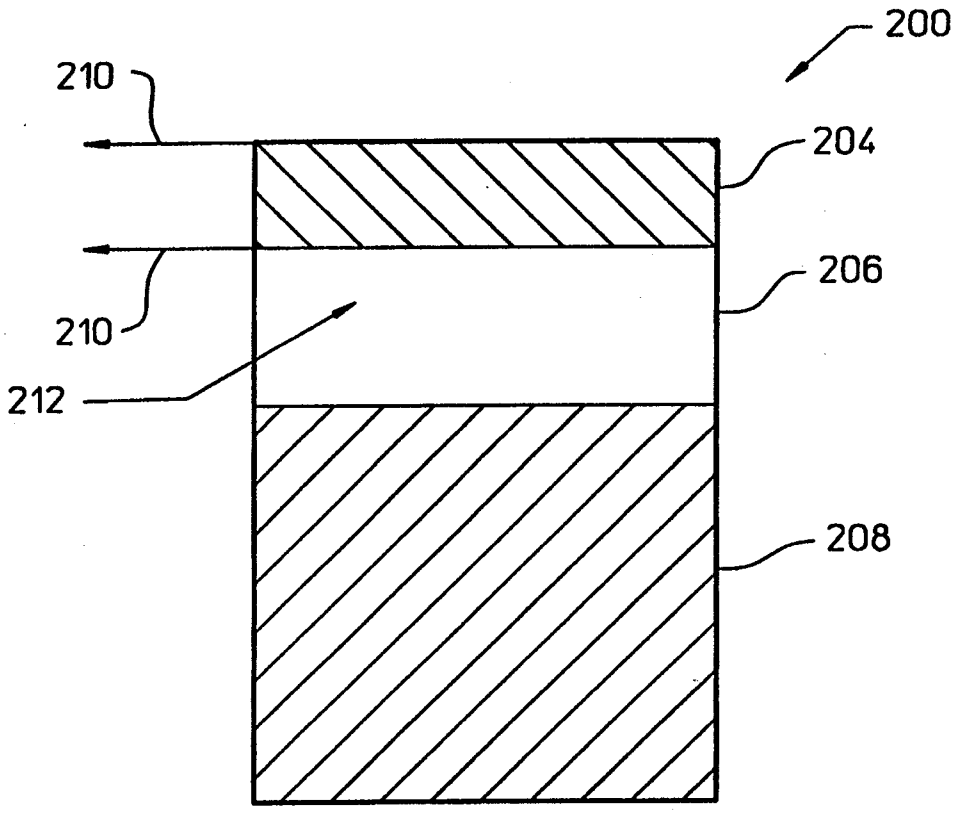
FIG. 2 (PRIOR ART)
FIG. 2 shows a cross sectional view of a previously known ultrasonic probe.
Figure 3:
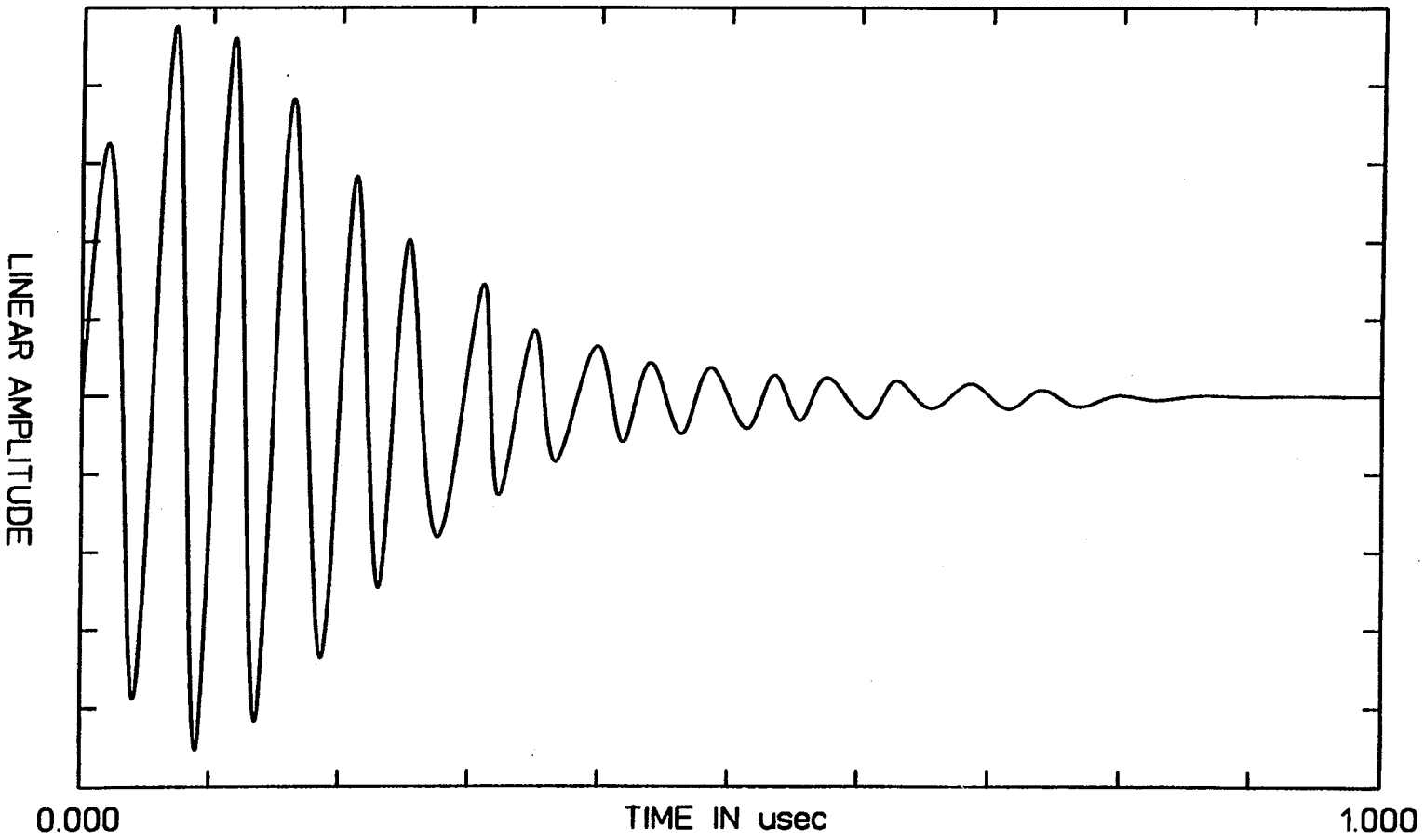
FIG. 3 (PRIOR ART)
FIG. 3 is a diagram illustrating a simulated impulse response of the transducer of FIG. 2.
Figure 11:
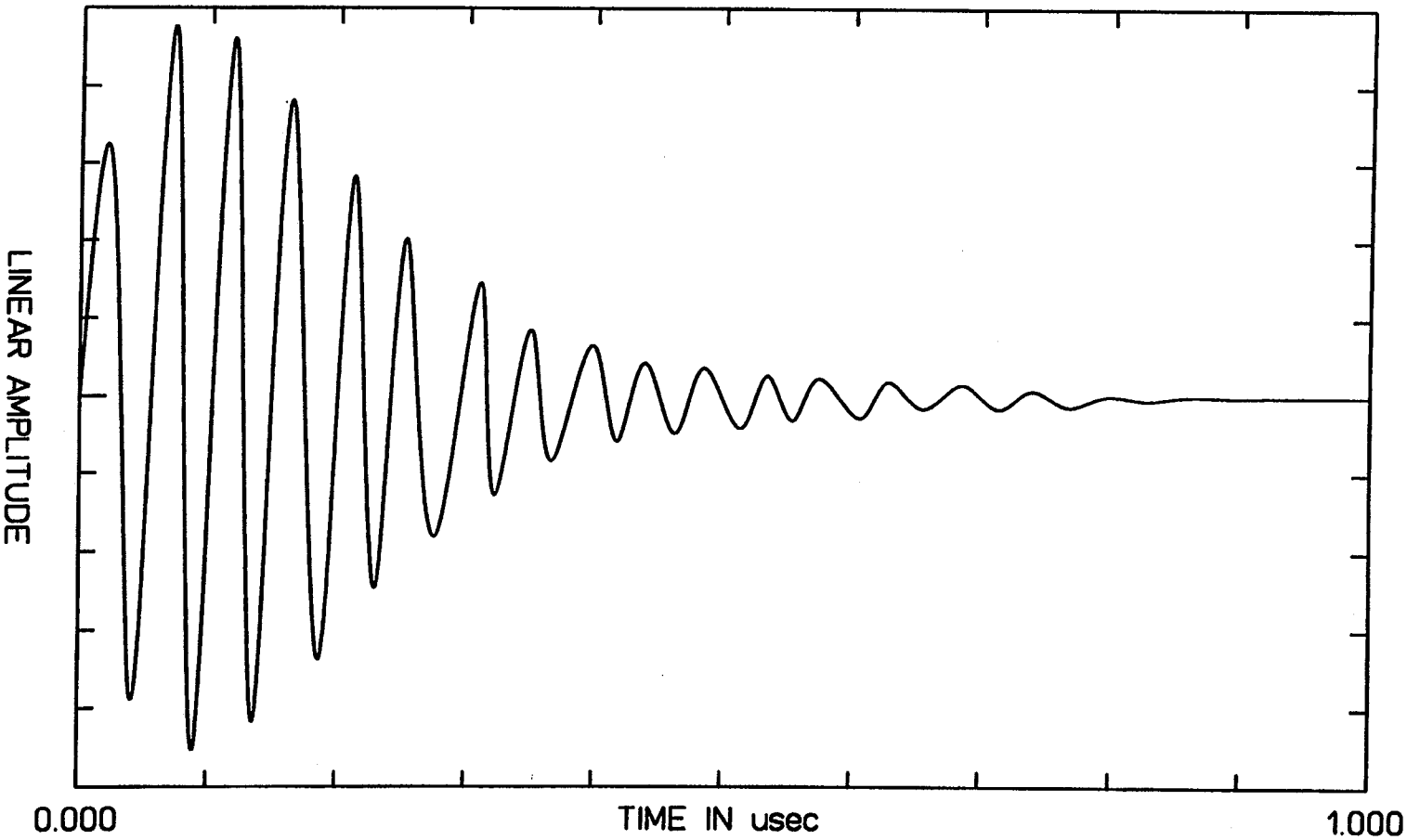
FIG. 11 is a diagram illustrating a simulated impulse response of a probe similar to that shown in FIG. 5.

FIG. 11 is a diagram of a simulated impulse response of a piezoelectric element similar to that shown in FIG. 5, but having a resonant frequency of 20 Megahertz, and radiating into water. In accordance with the impulse response diagram shown in FIG. 11, simulation predicts a reduced −6 decibel, rib, ring down time of 0.201 microseconds, usec, a reduced −20 db ring down time of 0.383 usec, and a reduced −40 db ring down time of 0.734 usec. In contrast, the impulse response of the previously known transducer shown in FIG. 3 and discussed previously herein shows the protracted ring down time.

Figure 12:
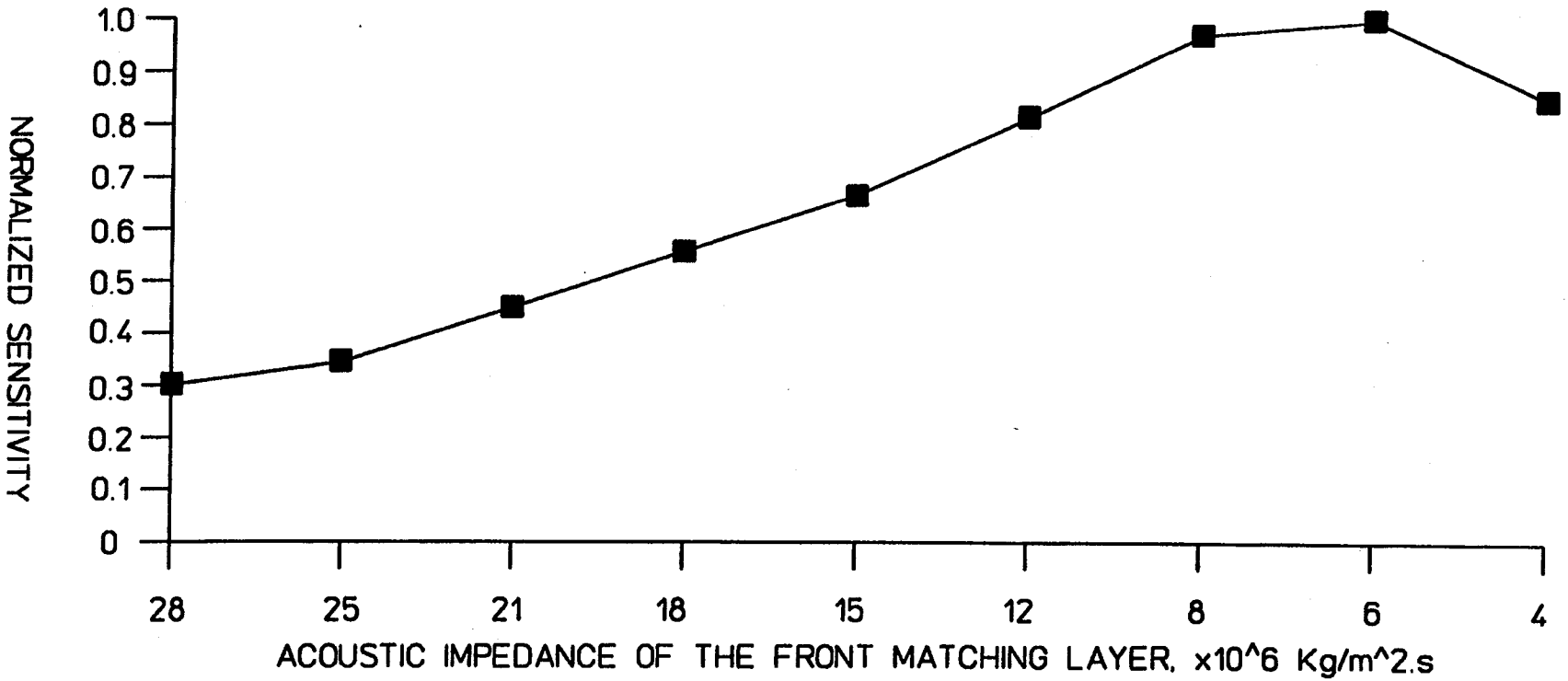
FIG. 12 is a diagram showing normalized sensitivity of the probe versus acoustic impedance of a respective second piezoelectric ceramic layer integral with a front face of each ceramic element.
Figure 13:
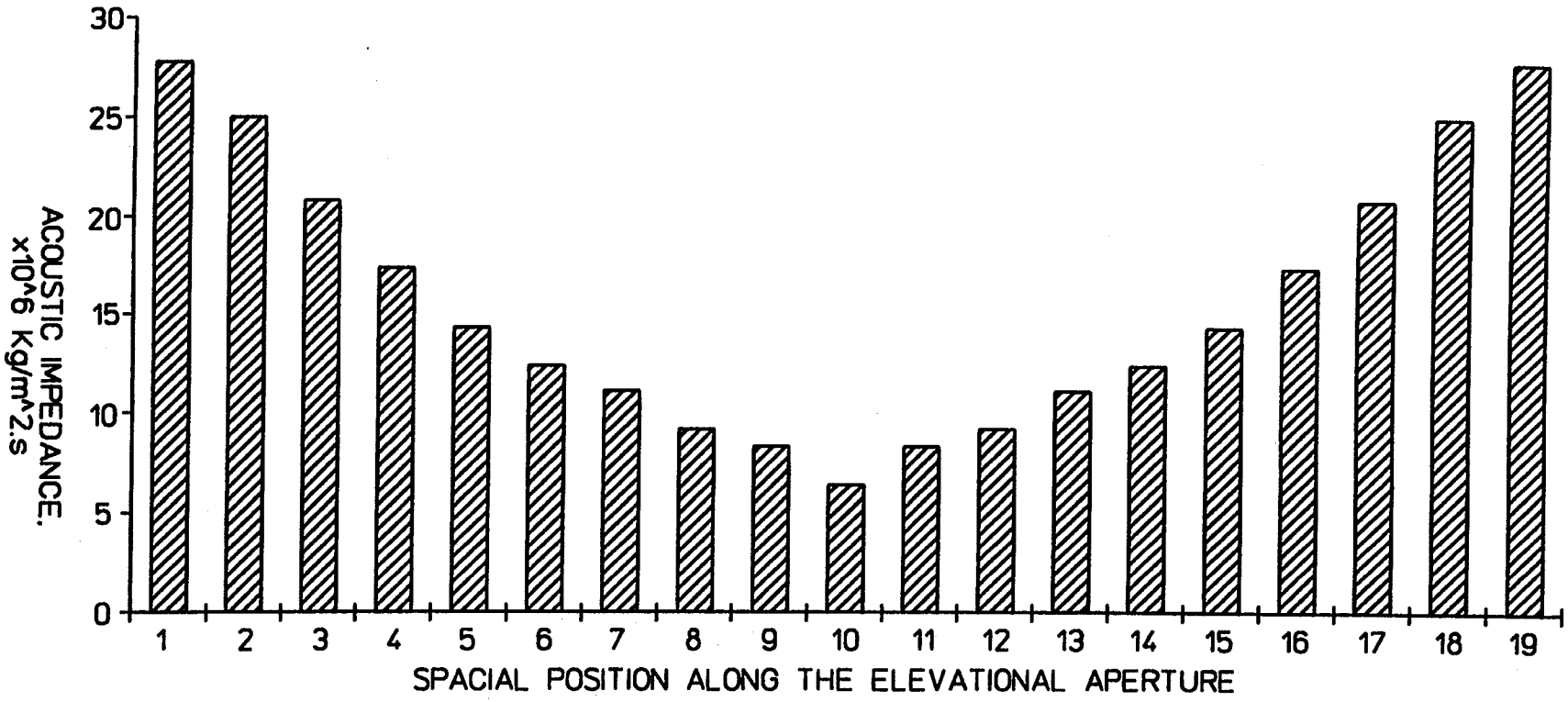
FIG. 13 is a diagram showing acoustic impedance of the second piezoelectric layer versus spatial location along the 19 zones of the elevational aperture, in accordance with the apodization function.

In an alternative embodiment, apodization is effected by a respective first piezoelectric layer integral with the rear face of each element, and is further effected using a respective second piezoelectric layer integral with a respective front face of each element. Respective sets of grooves extend through respective thicknesses of the first and second piezoelectric layers. A groove volume fraction of the first piezoelectric layer varies in accordance with the apodization function as discussed previously with respect to FIGS. 6, 7, and 8. Similarly, a groove volume fraction of the second piezoelectric layer also varies in accordance with the apodization function. FIG. 12 is a diagram showing how normalized sensitivity of the probe relates to acoustic impedance of the respective second piezoelectric ceramic layer integral with the front face of each ceramic element of the probe. In should be briefly noted that FIG. 12, which relates to the front face of each element, is distinctly different than FIG. 7, which relates to the rear face of each element. An acoustic impedance profile is then derived from FIGS. 6 and 12, in accordance with the apodization function. For example, FIG. 13 is a diagram showing acoustic impedance of the second piezoelectric layer versus spatial location along the 19 zones of the elevational aperture. Relevant groove dimensions of the grooves extending through the second piezoelectric layer are calculated based on zone acoustic impedances shown in FIG. 13, in a similar manner as discussed previously herein with respect to FIG. 8.

Figure 14:
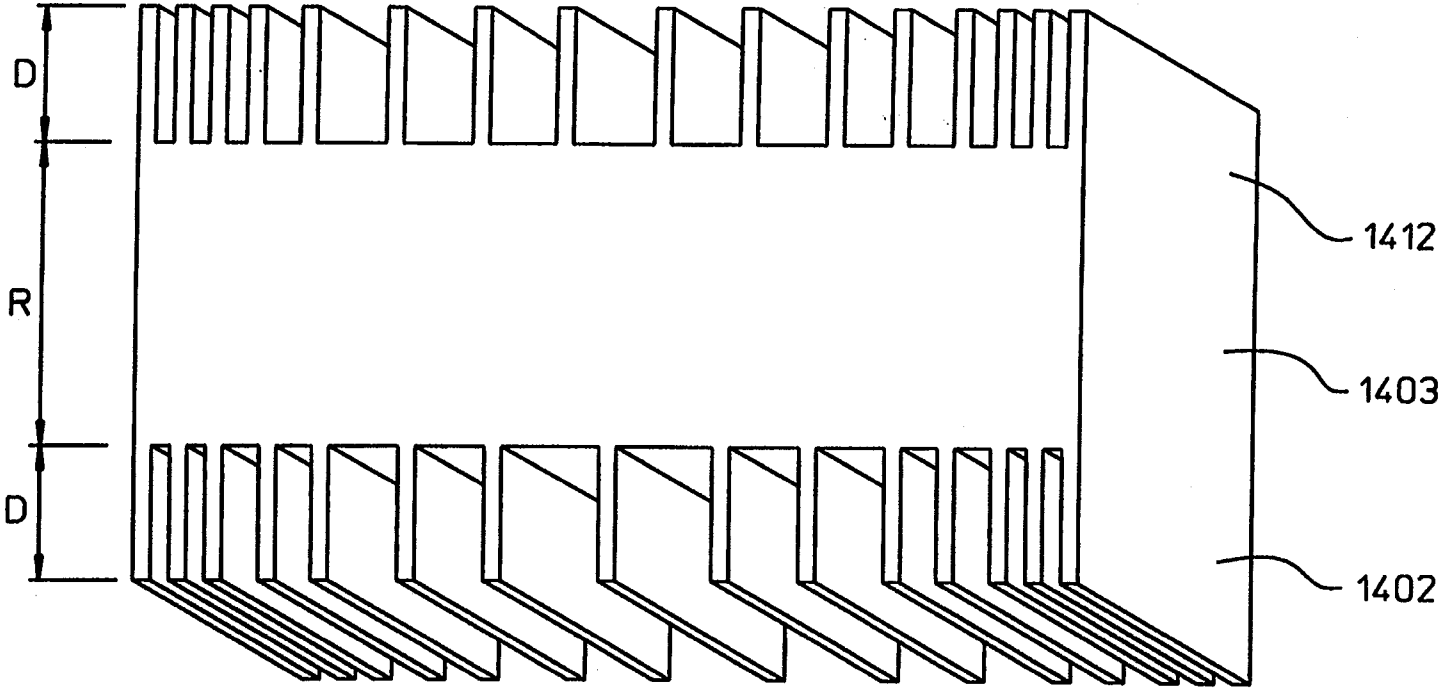
FIG. 14 illustrates another alternative embodiment of grooves employed in the invention, wherein the groove volume fraction of the first piezoelectric layer and of the second piezoelectric layer of each element are varied in accordance with the apodization function.

For example, FIG. 14 illustrates varying a width dimension of grooves in the first piezoelectric layer and the second piezoelectric layer to effect apodization. As shown, respective sets of grooves having depth, D, extend through respective thicknesses of the first and second piezoelectric layers. As shown, a slab of piezoelectric material has the first piezoelectric layer 1402 integral with the rear of the slab, similar to that shown in FIG. 10B discussed previously. In contrast to FIG. 10B, FIG. 14 further shows the second piezoelectric layer 1412 integral with the front face of the slab. A respective groove volume fraction of the first and second piezoelectric layer are varied along the elevational dimension, E, of the slab in accordance with the apodization function. A bulk remainder portion 1403 has a remainder dimension R. Sputtering, poling and dicing processes are performed upon the slab shown in FIG. 14 in a similar manner as discussed previously with respect to FIGS. 10C and D.

Figure 15:
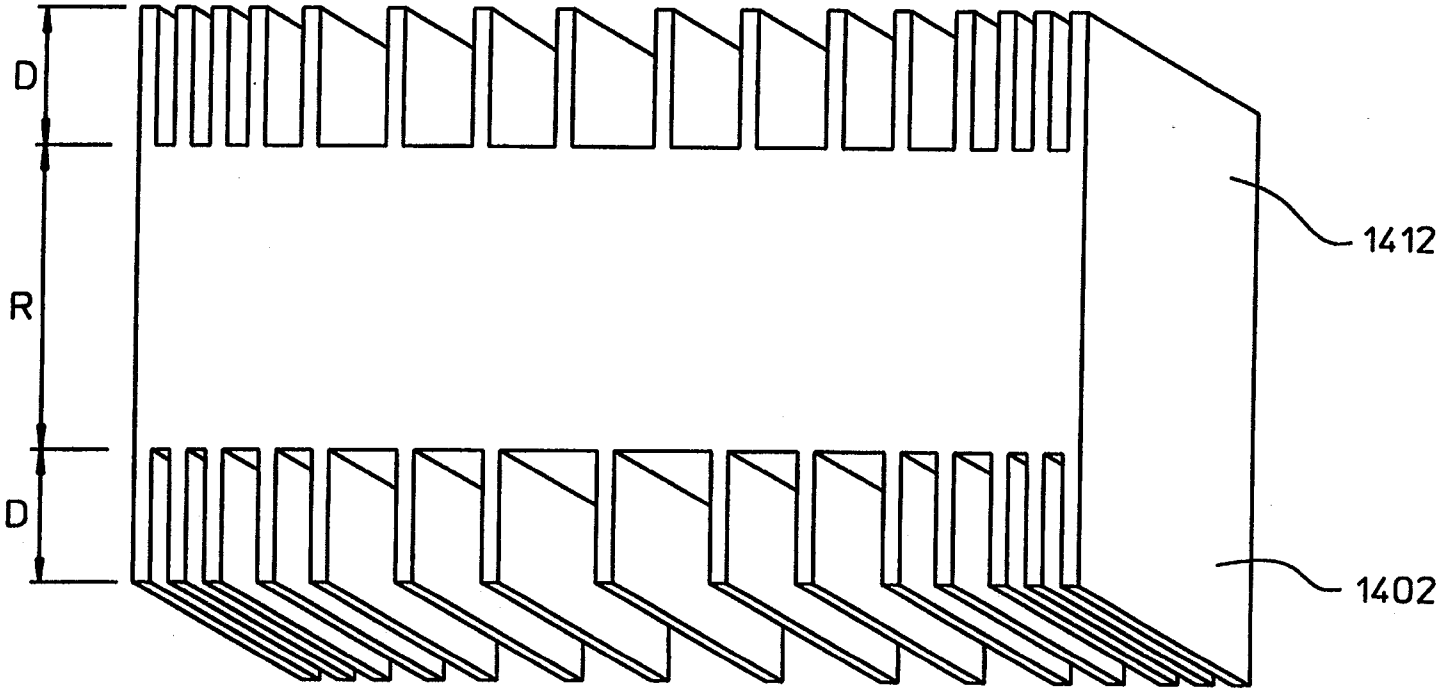
FIG. 15 illustrates another alternative embodiment of grooves employed in the invention, wherein the groove volume fraction of the first piezoelectric layer is varied along the elevational aperture in accordance with a first apodization function, and the second piezoelectric layer of each element is varied along the elevational aperture in accordance with a second apodization function.

In other alternative embodiments, the respective groove volume fractions of the first and second layers need not be determined by the same apodization function. For example, FIG. 15 illustrates yet another alternative embodiment of grooves employed in the invention, wherein the groove volume fraction of the first piezoelectric layer 1502 is varied along the elevational aperture in accordance with a first apodization function, and groove volume fraction of the second piezoelectric layer 1512 is varied along the elevational aperture in accordance with a second apodization function. In other respects, the alternative embodiment shown in FIG. 15 is similar to that shown in FIG. 14.

In yet another alternative embodiment, the second piezoelectric layer integral with the front face of each element is not use to effect apodization. Instead, focussing of the respective individual beams emitted by the front face of each element is achieved by varying the groove volume fraction of the second piezoelectric layer along the respective elevational dimension of each element in accordance with a suitable focussing function, such as a quadratic function. Just as the groove volume fraction controls acoustic impedance of the second piezoelectric layer, the groove volume fraction also controls velocity of acoustic waves through the second piezoelectric layer. Acoustic velocity through the layer controls time delay of acoustic signals through the layer, which in turn effects a desired focussing of the acoustic waves.

Figure 16:
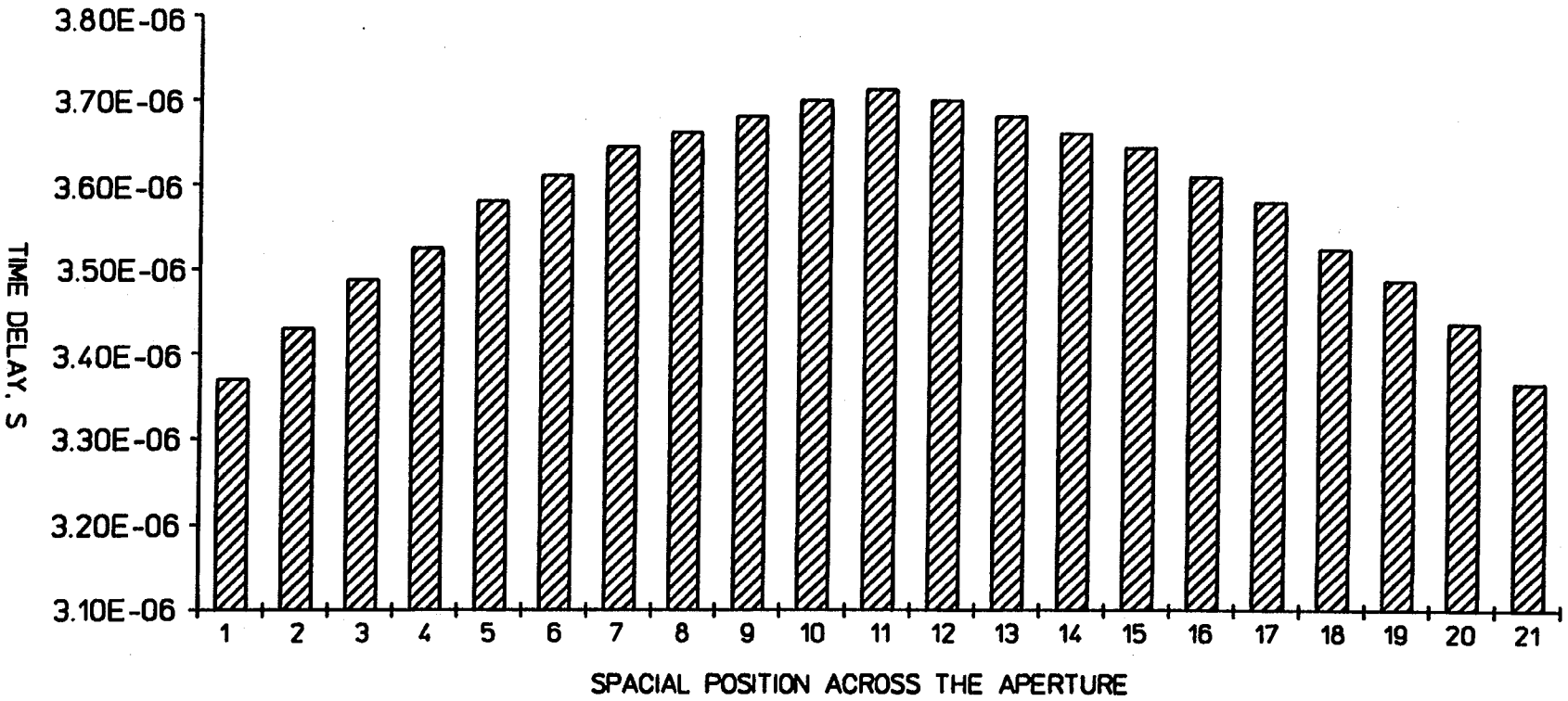
FIG. 16 is a diagram showing a desired acoustic signal time delay of the probe versus spatial location along 21 illustrative zones of the elevational aperture, in accordance with a suitable quadratic focussing function.
Figure 17:
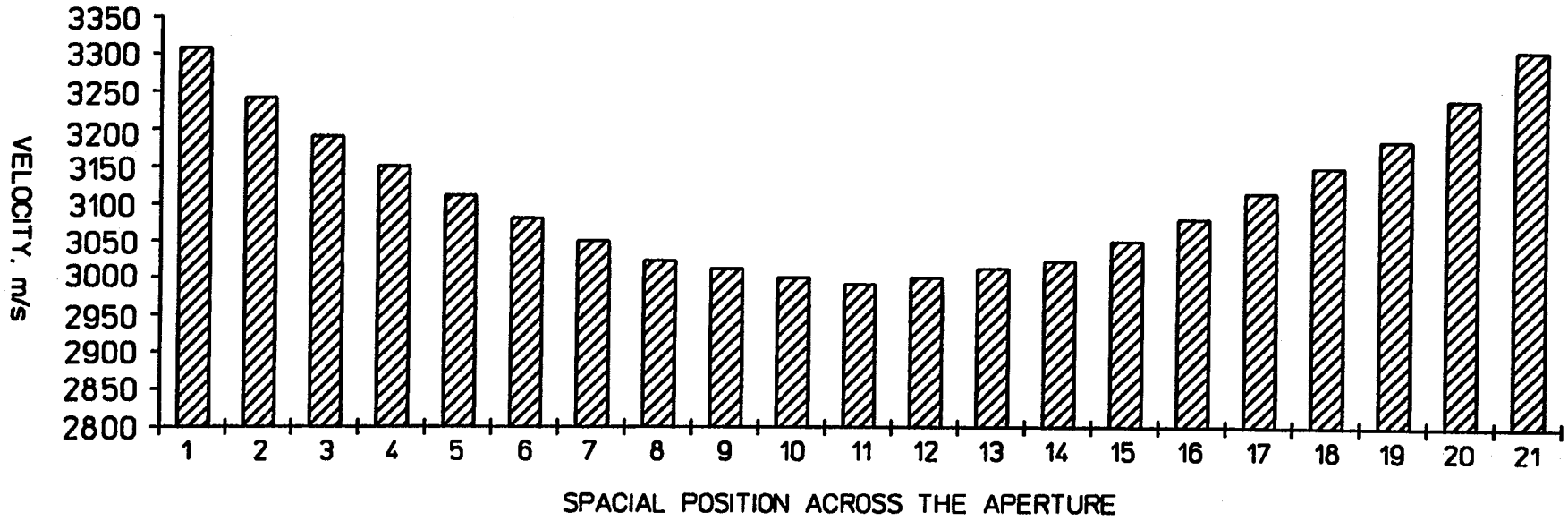
FIG. 17 is a diagram showing acoustic signal velocity through the second piezoelectric layer versus spatial location along the 21 zones of the elevational aperture, in accordance with the desired signal delay time delay, as illustrated in FIG. 16.
Figure 18:
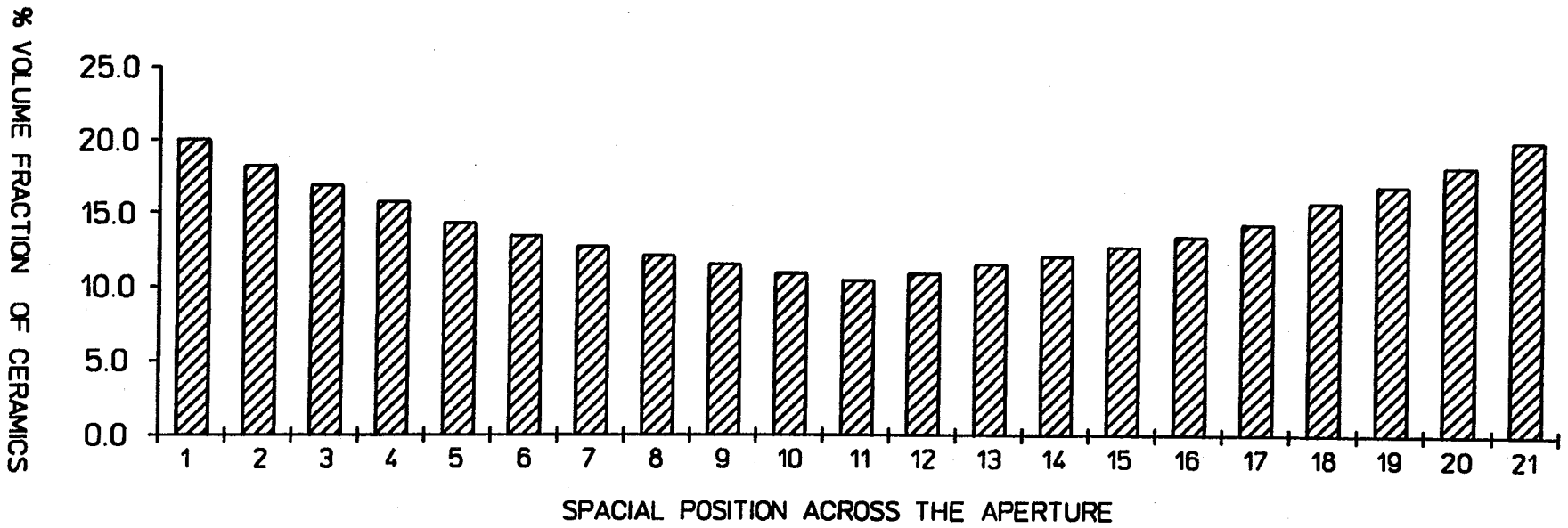
FIG. 18 is a diagram showing groove volume fraction of the second piezoelectric layer versus spatial location along the 21 zones of the elevational aperture, in accordance with the acoustic signal velocity through the second piezoelectric layer, as illustrated in FIG. 17.

For example, FIG. 16 is a diagram showing a desired acoustic signal time delay of the probe versus spatial location along 21 illustrative zones of the elevational aperture, in accordance with the focussing function. FIG. 17 is a diagram showing acoustic signal velocity through the second piezoelectric layer versus spatial location along the 21 zones of the elevational aperture, in accordance with the desired signal time delay, as illustrated in FIG. 16. FIG. 18 is a diagram showing groove volume fraction of the second piezoelectric layer versus spatial location along the 21 zones of the elevational aperture, in accordance with the acoustic signal velocity through the second piezoelectric layer, as illustrated in FIG. 17.

By selecting arrangement and dimensions of the grooves disposed on the surface of the piezoelectric element, desired acoustic properties of the piezoelectric ceramic layer are tailored to satisfy various acoustic frequency response requirements. In some alternative embodiments, the grooves include a plurality of sets of grooves in each piezoelectric element, for providing the piezoelectric elements with enhanced acoustic impulse frequency response. Each set of grooves includes members having a respective groove depth related to a respective wavelength of the acoustic signals. Such alternative embodiments are made in a similar manner as discussed previously with respect to FIGS. 10A–D.

Figure 19:
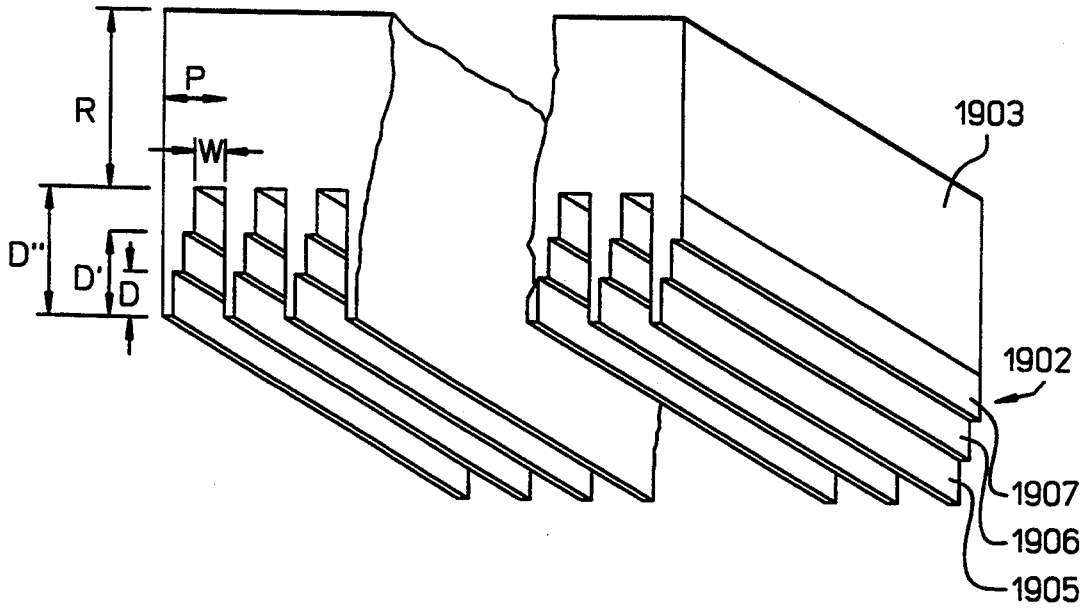
FIG. 19 is a simplified cut away isometric view illustrating an alternative embodiment of grooves extending through the piezoelectric layer of the present invention.

For example, yet another alternative embodiment of the inert piezoelectric layer of the present invention is illustrated in FIG. 19. FIG. 19 shows a simplified cut away isometric view of a slab of piezoelectric material having an inert piezoelectric layer 1902 integral with the slab, grooves extending through the layer, and a bulk remainder portion 1903 of the slab, similar to that shown in FIG. 10B discussed previously, In contrast to FIG. 10B, the grooves of FIG. 19 include a first set of grooves 1905, a second set of grooves 1906, and third set of grooves 1907 arranged adjacent one another. Each member of the first set of grooves is cut into the rear face of the piezoelectric element at a respective depth, D, which is approximately equal to an integral multiple of one quarter of a first wavelength of the acoustic signals. Similarly, each member of the second set of grooves has a respective depth dimension, D′, which is approximately equal to an integral multiple of one quarter of a second wavelength of the acoustic signals. Each member of a third set of grooves has a respective depth dimension, D″, which is approximately equal to an integral multiple of one quarter of a third wavelength of the acoustic signals. Respective members of the first, second and third set of grooves are arranged in a "stair step" pattern as shown in FIG. 19. A single conformal material can be deposited in each set of grooves. Alternatively, a different conformal material can be deposited in each set of grooves to achieve the desired frequency response. Furthermore, using this approach, the desired apedization of focussing function can be effected by selectively choosing the conformal material deposited into each set of grooves. Sputtering, poling and dicing processes are then performed in a similar manner as discussed previously with respect to FIGS. 10C and D in order to complete the alternative embodiment of the ultrasonic probe having enhanced frequency response.

Figure 20:
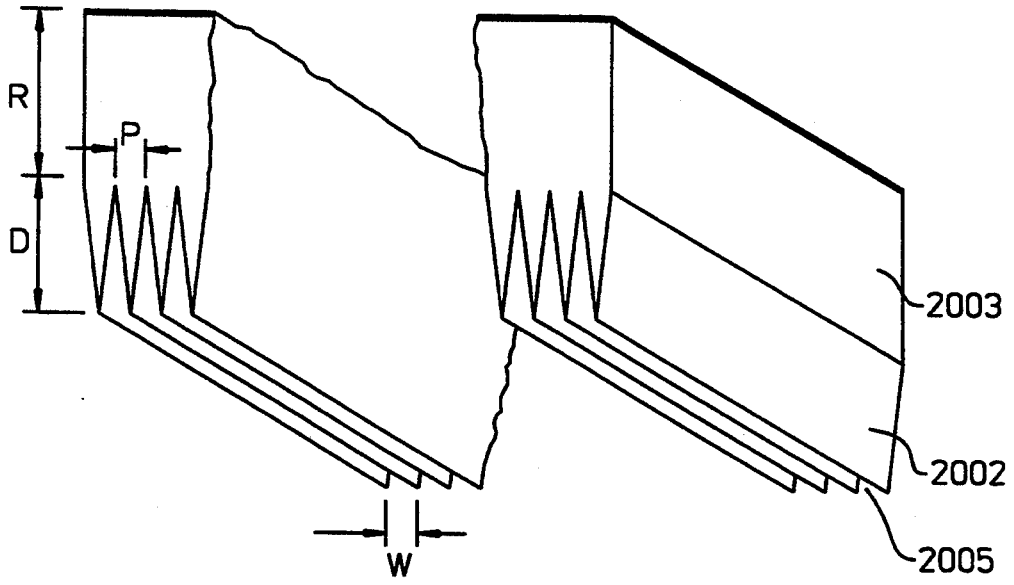
FIG. 20 a simplified cut away isometric view illustrating another alternative embodiment of grooves extending through the piezoelectric layer of the present invention.

In other alternative embodiments, a smoothed groove profile is etched, in place of the abrupt "stair step" pattern, to provide the piezoelectric elements with enhanced acoustic performance such as broad frequency response or improved acoustic sensitivity. For example, such alternative embodiments include grooves each having a smoothed "V" profile and extending into the rear surface of the piezoelectric element. Such alternative embodiments are made in a similar manner as discussed previously with respect to FIGS. 10A–D. For example, another alternative embodiment of the inert piezoelectric layer of the present invention is illustrated in FIG. 20. FIG. 20 shows a simplified cut away isometric view of a slab of piezoelectric material having a inert piezoelectric layer 2002 integral with the slab, grooves extending through the layer, and a bulk remainder portion 2003 of the slab, similar to that shown in FIG. 10B discussed previously, In contrast to FIG. 10B, the grooves of FIG. 20 include grooves 2005 having the smoothed "V" profile. Sputtering, poling and dicing processes are then performed in a similar manner as discussed previously with respect to FIGS. 10C and D in order to complete the alternative embodiment of the ultrasonic probe having enhanced frequency response.

Figure 21:
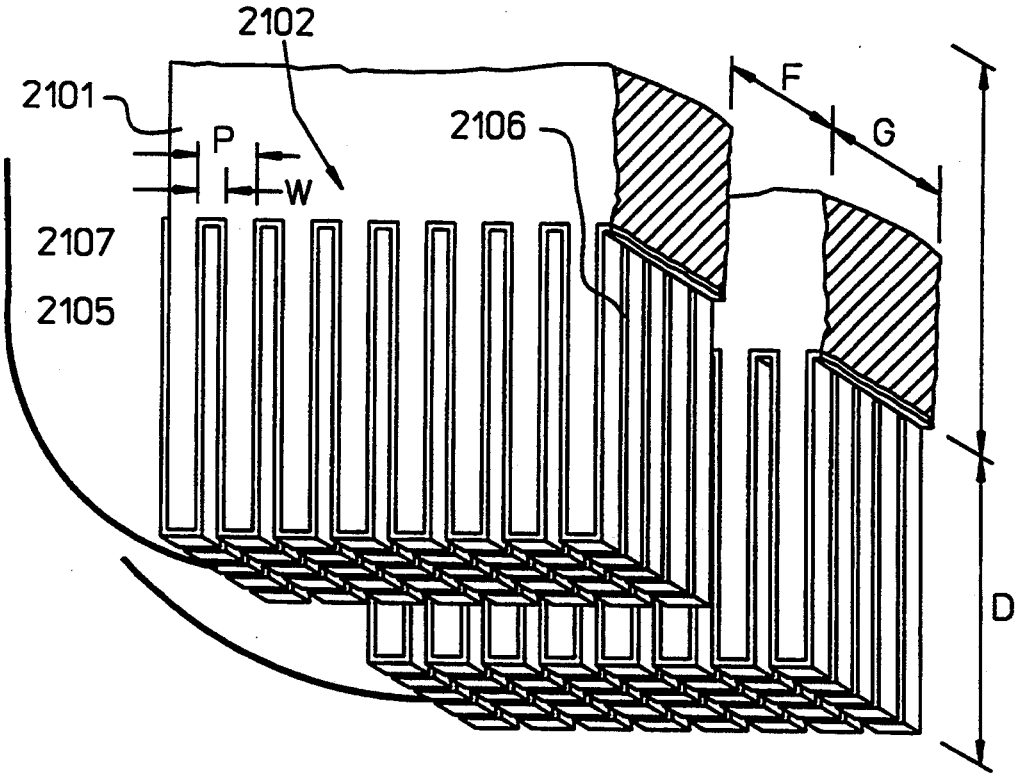
FIG. 21 is a detailed isometric view of yet another alternative embodiment of the invention.

Still other embodiments provide alternative arrangements of grooves on the respective front surface of each piezoelectric element. For example, in contrast to the preferred embodiment shown in detail in FIG. 5A wherein the grooves disposed on each piezoelectric element are arranged substantially parallel to one another, yet another preferred embodiment is shown in detail in FIG. 21 wherein each piezoelectric element 2101 includes a respective inert piezoelectric layer 2102 having a first and second set of grooves, 2105, 2106 arranged substantially perpendicular to one another on the respective rear surface of each element. A metal film is sputtered onto the rear face of each element to provide a respective rear electrode 2107 extending into and contacting the grooves. Accordingly, the metal film blankets the grooves. Air is used as a conformal material disposed in the grooves. Because of the arrangement of the grooves shown in FIG. 21, the layer has 1–3 connectivity. As discussed previously, the grooves are cut into the piezoelectric elements using a dicing machine so as to have depth, D, width, W, and pitch, P. Alternatively, the grooves are selectively etched into elements using photolithography and chemical etchants, or are ablated using a laser.

Figure 22:
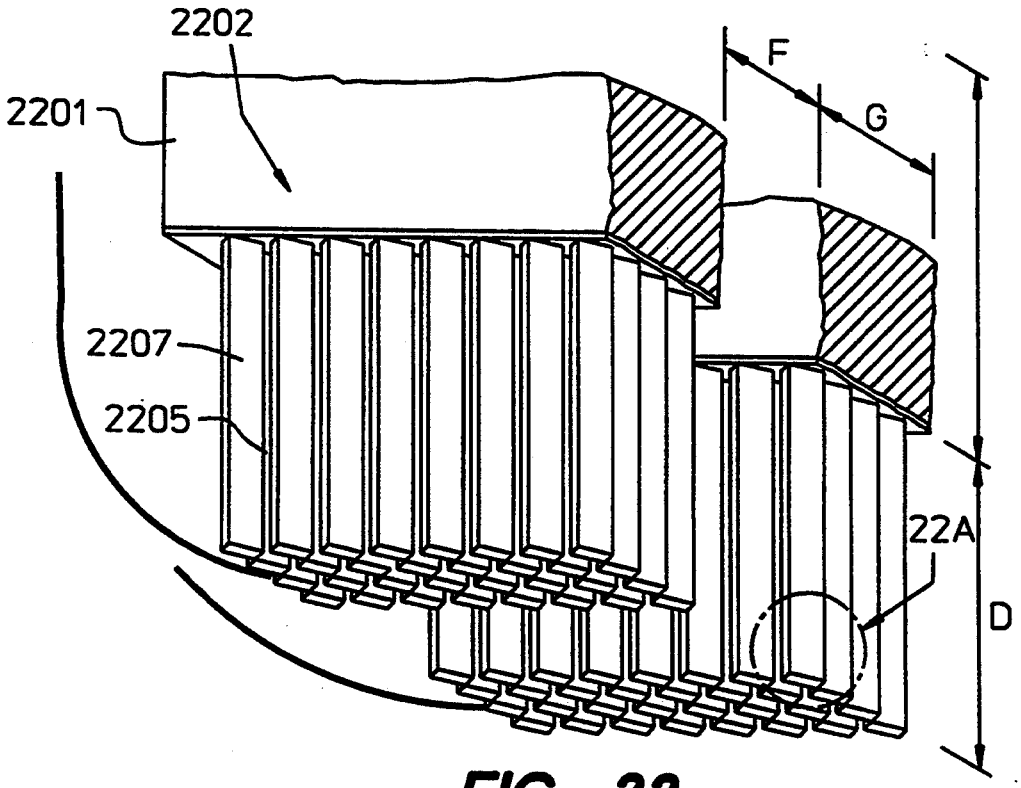
FIG. 22 is a detailed isometric view of yet another alternative embodiment of the invention.
Figure 22A:
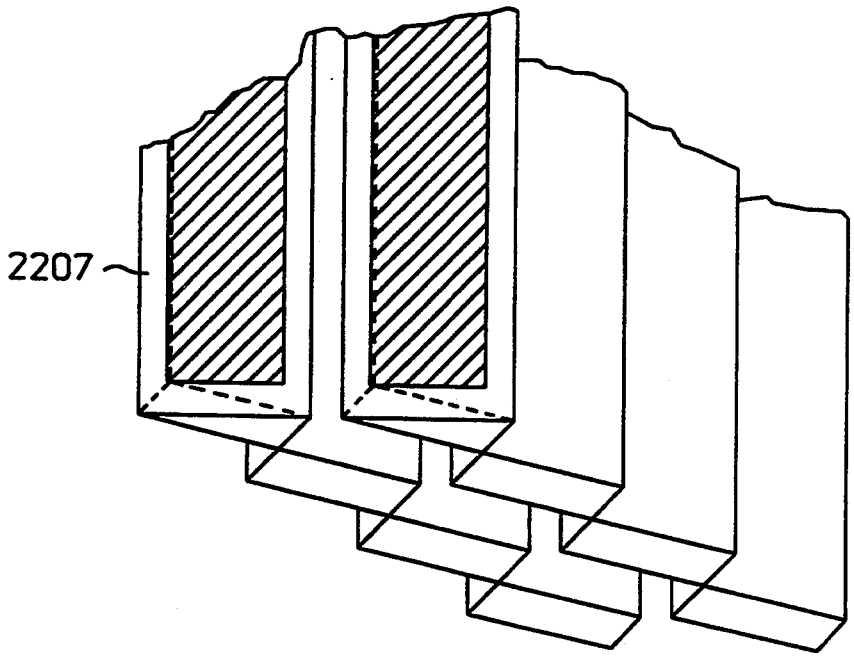
FIG. 22A is a further detailed cut away isometric view of a piezoelectric layer shown in FIG. 22.

Yet another alternative arrangement of grooves on the respective rear face of each piezoelectric element is shown in detail in FIG. 22 wherein each piezoelectric element 2201 includes a respective inert piezoelectric layer 2202 having specially contoured grooves 2205 etched into the layer. The specially contoured grooves provide lozenge shaped remainder ceramic portions of the piezoelectric layer. A respective rear electrode 2207 extending Into and contacting the grooves is deposited as a metal film by sputtering. The metal film blankets the groves of the layer. In a further detailed cut away view 22A, the metal film of the electrode is cut away to show the weakly poled piezoelectric ceramic material of the inert piezoelectric layer. Air, used as conformal material disposed in the grooves. Because of the specially contoured grooves shown in FIG. 22 the piezoelectric layer has 1—1 connectivity.

Although specific embodiments of the invention have been described and illustrated, the invention is not to be limited to the specific forms or arrangements of parts so described and illustrated, and various modifications and changes can be made without departing from the scope and spirit of the invention. Within the scope of the appended claims, therefore, the invention may be practiced otherwise than as specifically described and illustrated.

What is claimed is:

1. An ultrasonic probe for coupling a beam of acoustic signals between the probe and a medium, the probe comprising:

a body of a piezoelectric material having a piezoelectric layer contiguous with a bulk remainder portion of the piezoelectric material; and an apodization means integral with the body for apodizing the beam of acoustic signals, the apodization means comprising the piezoelectric layer.

2. An ultrasonic probe as in claim 1 wherein the apodization means includes grooves extending through the piezoelectric layer.

3. An ultrasonic probe as in claim 1 wherein the piezoelectric layer is weakly poled relative to the bulk remainder of the piezoelectric material.

4. An ultrasonic probe as in claim 3 wherein:

the bulk remainder of the piezoelectric material is sufficiently poled so as to be substantially electromechanically active; and the weakly poled piezoelectric layer is substantially electromechanically inert.

5. An ultrasonic probe for coupling a beam of acoustic signals between the probe and a medium, the probe comprising:

an ultrasonic transducer element having a surface; and an apodization means for apodizing the beam of acoustic signals, the apodizaition means comprising grooves disposed on the surface of the element.

6. An ultrasonic probe as in claim 5 further comprising an electrode extending into and contacting the grooves.

7. An ultrasonic probe as in claim 5 wherein the grooves are arranged in spaced apart relation on the surface of the element so as to effect a desired apodization of the acoustic beam.

8. An ultrasonic probe as in claim 5 wherein each groove has a respective width dimension selected so as to effect a desired apodization of the acoustic beam.

9. A probe as in claim 5 wherein the probe further comprises a conformal material disposed within the grooves.

10. An ultrasonic probe as in claim 5 wherein:

the element has a front face and a rear face; and the apodization means includes grooves disposed on the rear face of the element and grooves disposed on the front face of the element.

11. An ultrasonic probe as in claim 5 wherein:

the element has a front face and a rear face:

the apodization means includes grooves disposed on the rear face of the element; and the probe further includes an acoustic focussing means comprising grooves disposed on the front face of the element for focussing the beam of acoustic signals.

12. An ultrasonic probe as in claim 5 further comprising an acoustic focussing means integral with the element.

13. An ultrasonic probe as in claim 5 wherein:

the apodization means is integral with the element.

14. An ultrasonic probe as in claim 5 wherein the element includes a piezoelectric layer coupled with a bulk remainder of piezoelectric material, the grooves extending through the piezoelectric layer.

15. An ultrasonic probe as in claim 14 wherein the piezoelectric layer is weakly poled relative to the bulk remainder of piezoelectric material.

16. An ultrasonic probe as in claim 15 wherein:

the bulk remainder of piezoelectric material is sufficiently poled so as to be substantially electromechanically active; and the weakly poled piezoelectric layer is substantially electromechanically inert.

17. An ultrasonic probe for coupling a beam of acoustic signals between the probe and a medium the probe comprising:

an ultrasonic transducer element having a surface; and a focussing means for focussing the beam of acoustic signals, the focusing means comprising grooves disposed on the surface of the element.

18. An ultrasonic probe as in claim 17 further comprising an electrode extending into and contacting the grooves.

19. An ultrasonic probe as in claim 17 wherein the grooves are arranged in spaced apart relation on the surface of the element so as to effect a desired focussing of the acoustic beam.

20. An ultrasonic probe as in claim 17 wherein each groove has a respective width dimension selected so as to effect a desired focussing of the acoustic beam.

* * * * *